US011207231B2

(12) United States Patent
Mallisho

(10) Patent No.: US 11,207,231 B2
(45) Date of Patent: Dec. 28, 2021

(54) APPARATUS FOR TRANSPORTING A PATIENT

(71) Applicant: Amjad Mallisho, Basel (CH)

(72) Inventor: Amjad Mallisho, Basel (CH)

( * ) Notice: Subject to any disclaimer, the term of this patent is extended or adjusted under 35 U.S.C. 154(b) by 212 days.

(21) Appl. No.: 16/439,494

(22) Filed: Jun. 12, 2019

(65) Prior Publication Data

US 2019/0290521 A1 Sep. 26, 2019

Related U.S. Application Data

(63) Continuation of application No. PCT/EP2017/081590, filed on Dec. 5, 2017.

(51) Int. Cl.

| | |
|---|---|
| ***A61G 7/16*** | (2006.01) |
| ***A61G 7/10*** | (2006.01) |
| ***A61G 5/12*** | (2006.01) |
| ***A61G 5/04*** | (2013.01) |
| ***A61G 7/053*** | (2006.01) |

(Continued)

(52) U.S. Cl.

CPC ..... *A61G 7/165* (2016.11); *A61G 5/04* (2013.01); *A61G 5/125* (2016.11); *A61G 5/128* (2016.11); *A61G 7/053* (2013.01); *A61G 7/1007* (2013.01); *A61G 7/1019* (2013.01); *A61G 7/1042* (2013.01); *A61G 7/1046* (2013.01); *A61G 7/1059* (2013.01); *A61G 7/1086* (2013.01); *A61G 7/1088* (2013.01); *A61G 7/1092* (2013.01); *A61G 7/1096* (2013.01); *A61G 7/1098* (2013.01); *A61G 5/1059* (2013.01); *A61G 7/1065* (2013.01); *A61G 2200/34* (2013.01); *A61G 2200/36* (2013.01); *A61G 2203/44* (2013.01); *A63B 21/00181* (2013.01); *A63B 21/068* (2013.01); *A63B 22/0235* (2013.01); *A63B 22/0605* (2013.01);

(Continued)

(58) Field of Classification Search

CPC .... A61G 7/165; A61G 7/1019; A61G 7/1042; A61G 7/1046; A61G 7/1059; A61G 7/1065; A61G 7/1053

See application file for complete search history.

(56) References Cited

U.S. PATENT DOCUMENTS

| | | | |
|---|---|---|---|
| 7,003,820 B1 | 2/2006 | Iura et al. | |
| 9,038,212 B2 * | 5/2015 | Yamaguchi | A61G 7/1046 5/87.1 |

(Continued)

FOREIGN PATENT DOCUMENTS

| | | |
|---|---|---|
| EP | 2783671 A1 | 10/2014 |
| WO | 2009/126040 A2 | 10/2009 |

*Primary Examiner* — Eric J Kurilla

(57) ABSTRACT

An apparatus for transporting a patient. The apparatus includes a supporting portion to grasp part of the body of a patient. A footboard unit is provided upon which the patient is able to stand when supported by the supporting portion, the footboard unit movable along a floor by movable means. A frame is connected between the footboard unit and the supporting portion. The apparatus is configured so that the footboard unit is able to move in proximity to a bed upon which the patient is lying, whereat the supporting portion can grasp the part of the body of the patient, wherein the frame and the supporting portion are able to support the patient in transitioning from a lying position on the bed to a standing position adjacent the bed as the footboard unit is moved relative to the bed.

22 Claims, 26 Drawing Sheets

(51) Int. Cl.

| | |
|---|---|
| *A61G 5/10* | (2006.01) |
| *A63B 69/00* | (2006.01) |
| *A63B 21/00* | (2006.01) |
| *A63B 22/06* | (2006.01) |
| *A63B 21/068* | (2006.01) |
| *A63B 22/02* | (2006.01) |

(52) U.S. Cl.
CPC ..... *A63B 22/0664* (2013.01); *A63B 69/0064* (2013.01); *A63B 2210/50* (2013.01)

(56) References Cited

U.S. PATENT DOCUMENTS

| | | | | |
|---|---|---|---|---|
| 2010/0154115 | A1* | 6/2010 | Wernqvist ..... | A61G 7/1096 5/86.1 |
| 2012/0174314 | A1* | 7/2012 | Clement ..... | A61G 7/1019 5/81.1 R |

* cited by examiner

APPARATUS FOR TRANSPORTING A PATIENT

TECHNICAL FIELD

The present invention is generally related to an apparatus for transporting a patient, particularly to an apparatus for enabling the mobility of a disabled person, and more particularly to a specially adapted wheelchair and/or a specially adapted bed.

BACKGROUND

Some disabled persons have limited or no control of their body. Hence they experience difficulties in moving or standing. Also, such individuals who for a prolonged amount of time are in a lying or sitting position due to muscular paralysis, may obtain ulcerations of the skin due to their immobility. In the absence of physical training, disabled persons may not only be subject to more progressive muscular weakening, but also get aggravated health issues because of poor blood circulation, which again causes a number of secondary effects, such as an increased tendency of blood thrombosis, ulceration of the skin due to reduced blood supply to surface tissue, impairment of the heart etc. This means the care giver should help the patient moving from the bed to the wheelchair, from the wheelchair to the toilet and then back to the wheelchair and eventually to the bed. This is a lot of work for the care givers who might themselves suffer lower back pain or even a discus hernia because of the burden they need to deal with while they help the disabled person performing their basic needs, like going to the bathroom. In addition, the disabled person can suffer and adverse psychological effect, when they see how they are dependent on the care giver.

The existing training methods and apparatuses require interaction between the patient and the nurses, therapist or caregivers. Generally, the disabled person may have to be present at a hospital or a special training centre in order to make it possible to have help from the caregivers to carry out the training exercises.

There is a need of an apparatus to assist moving a patient from a lying position to a standing position, to move the patient to a bathroom and then back to the bed. An apparatus that allows a patient to achieve these functions without assistance from a care provider would also be desirable. Further, an apparatus that allows training of the patient would be further desirable to improve the circulatory condition of the disabled person in order to prevent spasticity and to restore muscular functionality to the legs and torso. Further, it is desirable to have an integrated apparatus allowing sitting, standing, and training and optionally walking, which may be operated by the disabled person.

Further limitations and disadvantages of conventional and traditional approaches will become apparent to one of skill in the art through comparison of described systems with some aspects of the present disclosure, as set forth in the remainder of the present application and with reference to the drawings.

SUMMARY OF THE INVENTION

The invention can be described as an apparatus, a specially adapted wheelchair or as a specially adapted bed for disabled patients. It serves the purpose of transporting a disabled person. For example, transporting a disabled patient, who is lying in bed or being laid in bed, to the bathroom (for example) and bringing him or her back to bed.

In one aspect of the present disclosure, there is provided an apparatus for transporting a patient, the apparatus comprising:

- a supporting portion to grasp part of the body of a patient;
- a footboard unit upon which the patient is able to stand when supported by the supporting portion, the footboard unit movable along a floor by movable means;
- a frame connected between the footboard unit and the supporting portion;
- the apparatus configured so that the footboard unit is able to move in proximity to a bed upon which the patient is lying, whereat the supporting portion can grasp the part of the body of the patient, wherein the frame and the supporting portion are able to support the patient in transitioning from a lying position on the bed to a standing position adjacent the bed as the footboard unit is moved relative to the bed.

In this way, assistance is provided for moving the patient out of the bed and away from the bed. Further, by supporting the patient in a standing position, possibilities are provided for training or exercising the patient's legs. The standing position may also assist the patient's mental disposition as compared to sitting in a wheel chair.

In one of the embodiment the apparatus forms part of a special bed for disabled patients. The frame and supporting portions form the side of the bed. The footboard unit is located at a footboard end of the bed which can be configured in a vertical way at the foot side of the bed as usual. This same footboard can then be configured in a horizontal way on the ground so that the patient can stand on it. The supporting portions, the frame and the footboard can then be separated from the rest of the bed.

Such an embodiment allows for an integrated stowed configuration for the apparatus in addition to convenient location adjacent the patient for grasping the patient in the lying position.

In one embodiment, the supporting portion comprises a supporting or mattress layer of a bed upon which the patient lays and which is separable from the rest of the bed.

In another embodiment, the apparatus is able to be arranged into a wheelchair which includes opposed parts of the frame and supporting portions that can be spaced apart to grasp the patient on either side of the patient and then transformed to move the patient into a sitting position. The apparatus is also able to support the patient in a standing position and enable the patient to move around.

In an embodiment, different supporting portions are arranged for grasping the patient (the disabled person) at different parts of the body to enable optimal and assured mobilization of the patient, optionally to a sitting position, and also then to a standing position on the footboard, which has been configured in a horizontal position.

This apparatus can take the patient to the bathroom and facilitate having a bowel movement or urinating of the disabled person.

The apparatus can provide optimal training settings for a disabled person while he or she is being grasped (held) by the at least one supporting portion to perform certain exercises.

In embodiments, all the movements of the apparatus are performed by motorization and optionally can be operated manually. In alternative embodiments, the apparatus operates just manually.

BRIEF DESCRIPTION OF DRAWINGS

The accompanying drawings illustrate the embodiments of systems, apparatus, methods, and other aspects of the disclosure in an exemplary way. The shown elements may not be drawn to scale.

Various embodiments will hereinafter be described in accordance with the appended drawings, which are provided to illustrate, not limit, the scope, wherein similar designations denote similar elements, and in which.

DETAILED DESCRIPTION OF THE INVENTION

Patient in this document may refer to a disabled person, for example partially or totally paralysed individual.

References to "one embodiment", "at least one embodiment", "an embodiment", "one example", "an example", "for example", and so on indicate that the embodiment(s) or example(s) may include a particular feature, structure, characteristic, property, element, or limitation, but not every embodiment or example necessarily includes that particular feature, structure, characteristic, property, element, or limitation. Furthermore, repeated use of the phrase "in an embodiment" does not necessarily refer to the same embodiment.

Unless defined otherwise, all technical and scientific terms used herein have the same meaning as commonly understood by one of the ordinary skills in the art to which this invention belongs. Although any method and material similar or equivalent to those described herein can also be used in the practice or testing of the present invention, the preferred methods and materials have been described. All publications, patents, and patent applications mentioned herein are incorporated in their entirety.

It is noted that as used herein and in the appended claims, the singular forms "a", "and", and "the" include plural referents, unless the context clearly dictates otherwise. In the claims, the terms "first", "second", and so forth are to be interpreted merely as ordinal designations; they shall not be limited in themselves. Furthermore, the use of exclusive terminology such as "solely", "only", and the like in connection with the recitation of any claim element is contemplated. It is also contemplated that any element indicated to be optional herein may be specifically excluded from a given claim by way of a "negative" limitation. Finally, it is contemplated that any optional feature of the inventive variation(s) described herein may be set forth and claimed independently or in combination with any one or more of the features described herein.

All references cited herein, including publications, patent applications, and patents, are hereby incorporated by reference to the same extent as if each reference were individually and specifically indicated to be incorporated by reference, and were set forth in its entirety herein.

Referring to the figures, the apparatus (FIG. 1: 10) serves the purpose of transporting a disabled person. For example, transporting a disabled patient, who is lying in a bed or being laid in a bed, to the bathroom and bringing him or her back to the bed.

Figure 1:
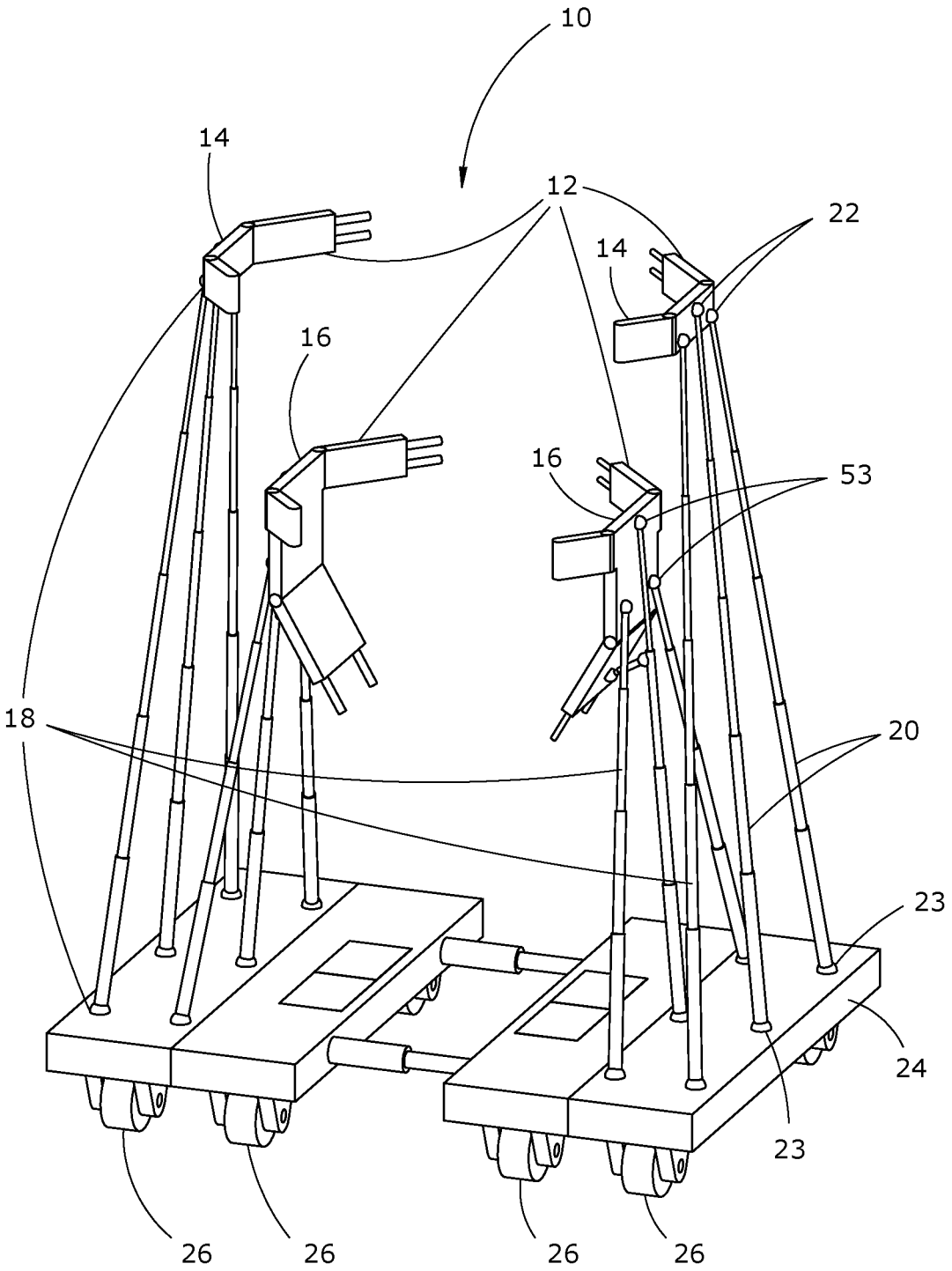
FIG. 1 shows an apparatus 10 for transporting a patient according to an example of the present disclosure. The apparatus of FIG. 1 includes a supporting portion 12, a frame 18 and a footboard 24.

FIG. 1 shows an apparatus 10 that comprises a supporting portion 14, 16. The supporting portion 14, 16 comprises an upper supporting portion 14 and a waist supporting portion 16. The upper supporting portion 14 is for grasping about the upper torso of a patient, for example under the arms of the patient and around the front and back of the patient. The waist supporting portion is for grasping around the waist of the patient including the front and the back. The apparatus 10 comprises a footboard 24 upon which a patient may stand and a frame 18 connecting the footboard 24 and each supporting portion 14, 16. The frame 18 is made of rods 18, 20. Spherical joints 22 are provided between the rods and the footboard 24 and spherical joints 23 are provided between the footboard 24 and each supporting portion 14, 16 to allow relative movement of the footboard 24 and each supporting portion 14, 16 in three dimensions (height and longitudinal and lateral directions relative to the floor). Movable means 26 are included on the footboard 24 in the form of wheels to allow the footboard and the patient on the footboard to be transported around a care facility. The supporting portions serve the purpose of grasping part of the body of a patient. Depending on the kind and the severity of the disability the patient has, the apparatus will have different sets of supporting portions. There is an upper supporting portion (FIG. 1: 14) for grasping under the arms of the patient, a lower supporting portion (alternatively termed a waist supporting portion) (FIG. 1: 16) for grasping around the waist of the patient, a leg supporting portion (FIG. 11A: 82: second (left) side part of the leg supporting portion) for grasping the legs of the patient. The apparatus 10 can comprise one, two or all three kinds of supporting portions 14, 16, 82. The type and the severity of the disability is essential to decide on which supporting portion is suitable for a specific patient. That is to say, if the upper or the lower body is paralyzed or both and if the paralysis is partial or complete.

Let's take for example the case of a patient with completely paralyzed lower body (both legs). In this case the apparatus 10 will have at least a waist supporting portion 16 or a leg supporting portion 82 or preferably both. In this case, there may be no need for the upper supporting portion 14.

Optionally other supporting portions could be added to support other parts of the body like supporting the head/arms, the upper legs, lower legs, knees and/or soles of the feet as needed.

The supporting portion 16 comprises separable first and second parts (FIG. 2: 28 and 33) respectively locatable on opposed sides of the patient and connectable to one another behind the back of the patient and underneath the buttocks/thighs of the patient, when configuring the seat of the chair.

Figure 2:
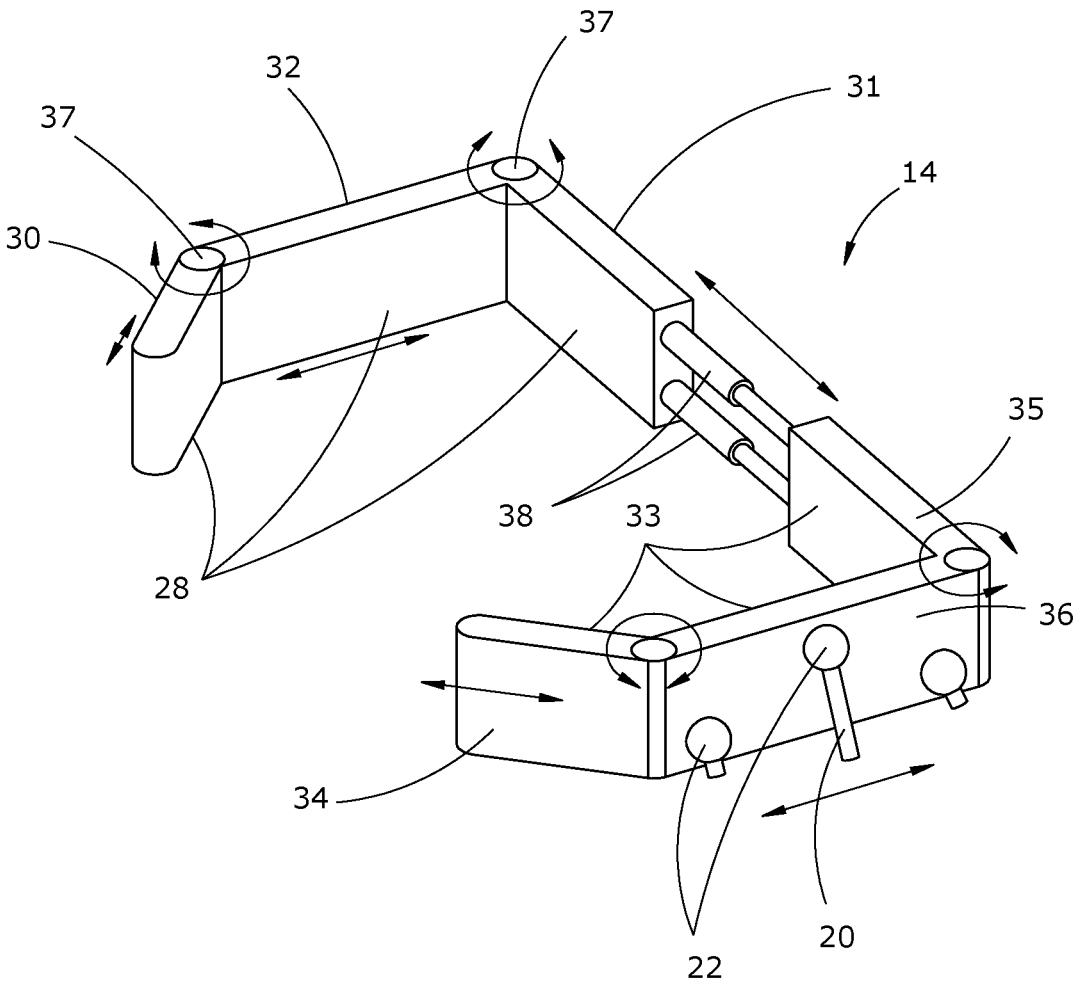
FIG. 2 shows an upper supporting portion 14 for grasping the upper body of a patient according to an example of the present disclosure.
Figure 3:
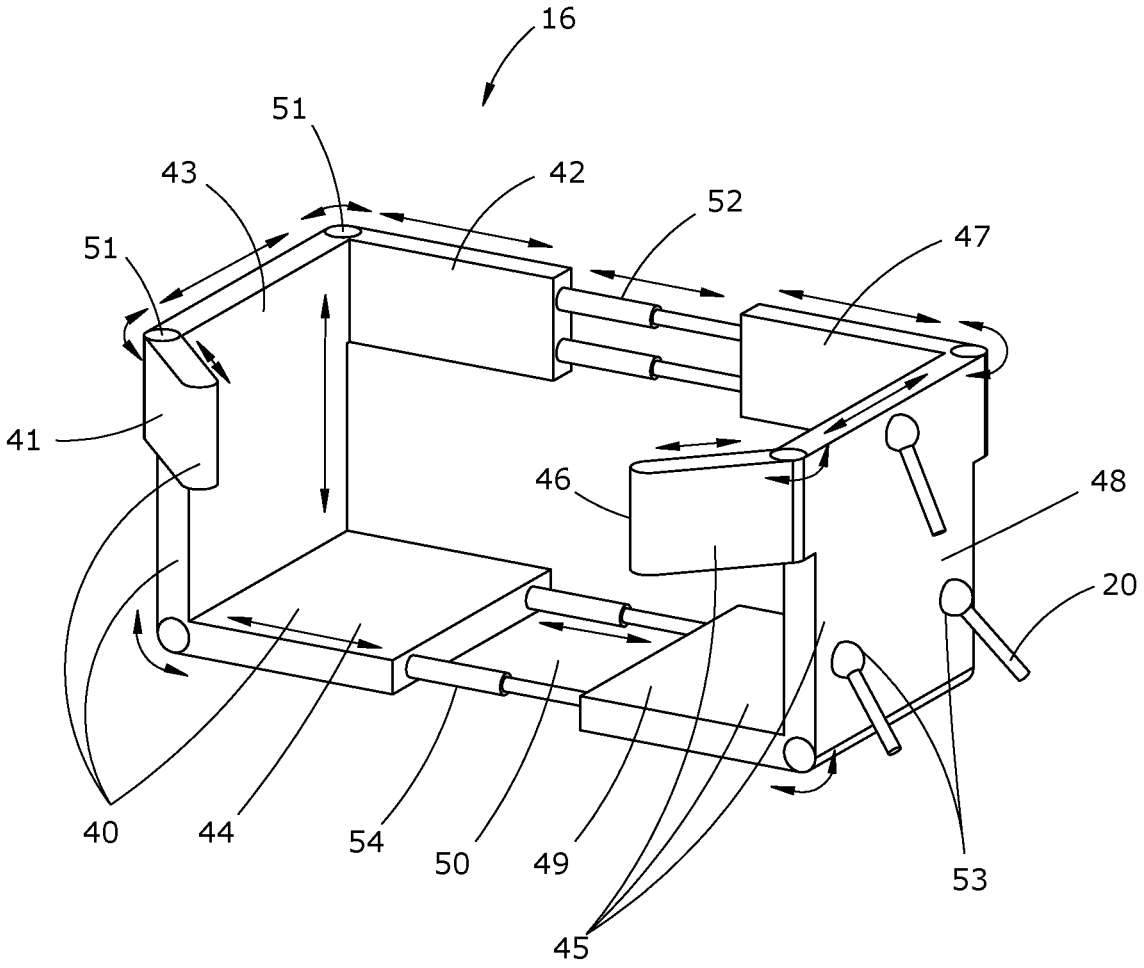
FIG. 3 shows a lower supporting portion 16 for grasping the lower body of a patient and for configuring the seat of the wheelchair according to an example of the present disclosure.

In the exemplary embodiment, the opposed sides 28, 33 are connectable through a rigid connection (FIG. 2: 38; FIG. 3: 52 and 54). The rigid connection may comprise at least one pair of connectable rods 52, 54. The apparatus 10 comprises a frame (FIG. 1: 18) connecting between the footboard unit (FIG. 1: 24) and the supporting portions (FIG. 1: 12). This frame could comprise one, two, three or more rods 18, 20 for each supporting portion 14, 16, 82, which are connected to the supporting portions 14, 16, 82 and the footboard 24 with spherical joints (FIGS. 1: 22 and 23; FIG. 3: 53). The height of this frame 18, 20 should be adjustable to accommodate the patient in lying standing and sitting positions. The height adjustability is optionally motorized and it has a telescopic mechanism for the height adjustability.

Alternatively, the different parts of the footboard 24 can be spaced apart in a diagonal way (laterally spaced apart and/or longitudinally) which will change the height and position of the rods attached to it and will increase the stability of the footboard for mobilising a tall patient for example.

The rods 18, 20 can be attached to any part of the footboard.

In embodiments, the rods 18, 20 have spherical joints, which may be motorised, at least at the attachment point (FIG. 1: 23) to the footboard (FIG. 1: 24) and/or at the attachment point (FIG. 1: 22) to the supporting portion (FIG. 1: 14). Therefore, the rods 18, 20 are able to pivot relative to the footboard unit 24 and in the same way the supporting portions 14, 16, 82 will pivot relative to the rods. Adjusting the height of the frame (rods 18, 20) and pivoting of the rods 18, 20 relative to the footboard 24 and to the supporting portion 14, 16, 82 will enable the supporting portions 14, 16, 82 to come closer to the part of the patient's body that needs to be grasped by the supporting portion 14, 16, 82.

Optionally, additional spherical joints (not shown in the drawings) could be added, for example, in the middle of the rods or at any other point of the different rods. This will enable even more flexibility to the movement of the rods to the supporting portions to make it even easier to grasp a patient lying in the middle of a broad bed, for example.

All spherical joints are optionally motorized and the ability to grasp is preferably motorised.

In use, the supporting portions slide behind the part of the body being grasped. This will require applying some pressure on the mattress to facilitate sliding behind that part of the body. The part of the body needing to be grasped could be the back, the waist, the legs or any other part of the body of the disabled person. The motorised spherical joints with the ability to pivot and to adjust the height of the rods will enable the grasping to take place smoothly.

In an embodiment, a sensor can be used to ensure optimal grasping pressure applied to the patient. The sensor and a controller can operate in a feedback loop with the motorized ability to grasp. Optimal pressure can be set relative to the weight and size of the disabled person, to ensure safe grasping of the patient.

The supporting portions can slide and extend behind around the part of the patient's body that needs to be grasped in a, optionally motorized, telescopic mechanism 38 as shown in FIG. 2.

In an alternative embodiment not shown in the figures, the supporting portions comprise a harness. For example, the waist supporting portion 14 can comprise a waist and/or upper leg harness, wherein the waist harness comprises a belt for harnessing around the waist of the patient and the leg harnesses are for harnessing around the legs of the patient. The upper supporting portion 16 optionally comprises an upper harness comprising a belt harnessed around the chest of the patient.

In another alternative embodiment that is not shown in the figures, the apparatus forms part of a bed and is able to be separated from the rest of the bed. This separable part of the bedding or at least the upper layer of the mattress will become upper layer of the supporting portions. In this embodiment, the supporting portion will smoothly slide underneath these separable part of the mattress/beddings, like sliding in an already made pocket in the upper layer of the mattress and fix the patient on the supporting portion to enable the transportation.

Figure 10A:
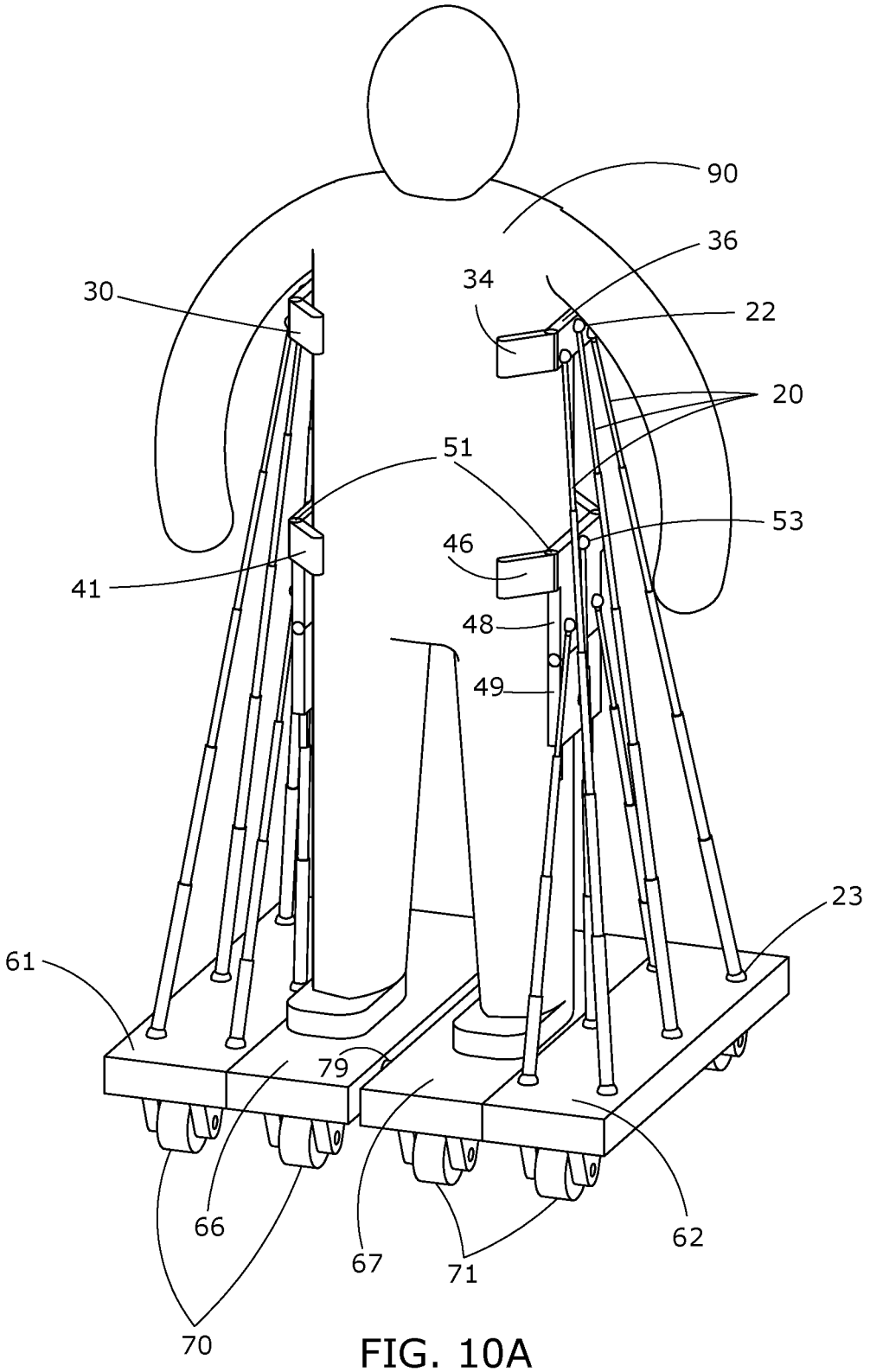
FIG. 10A shows a patient being supported by the apparatus (embodiment with upper and lower supporting portions) in a standing position, according to an example of the present disclosure.

FIG. 10A shows a patient 90 being supported by the apparatus 10 (embodiment with upper and lower supporting portions) in a standing position and while being transported. In FIG. 10A, there is shown a right front part of the upper supporting portion 30, left front part of the upper supporting portion 34, left side part of the upper supporting portion 36, motorized Spherical joints (rods, supporting portion) 22, rods 20, Joints between the different parts (for example between the side and front parts) 51, right front seat part of the lower supporting portion 41, left front seat part of the lower supporting portion 46, left side seat part of the lower supporting portion 48, left lower bottom seat part of the lower supporting portion 49, motorized Spherical joints (rods, supporting portion) 53, First (right) Part of the footboard carrying the frame 61, Second (left) Part of the footboard carrying the frame 62, First (right) Central part of the footboard 66, Second (left) Central part of the footboard 67, First (right) Movable means 70, Second (left) Movable means 71 and First right set of connection to space the footboard away and to pull it together as needed 79.

The patient can stand on the footboard unit 24 when supported by the supporting portion 12, 14. The footboard unit 24 is movable along a floor by movable means 26 such as wheels. This will enable transporting the disabled patient for example from the bed to the toilet and back.

The apparatus 10 is configured so that the footboard unit 24 is able to move in proximity to a bed upon which the patient is lying, whereat the supporting portion 12, 14 can grasp part of the body of the patient, wherein the frame 18 and the supporting portion 12, 14 are able to support the patient in transitioning from a lying position on the bed to a standing position adjacent the bed as the footboard unit is moved relative to the bed.

Figure 6:
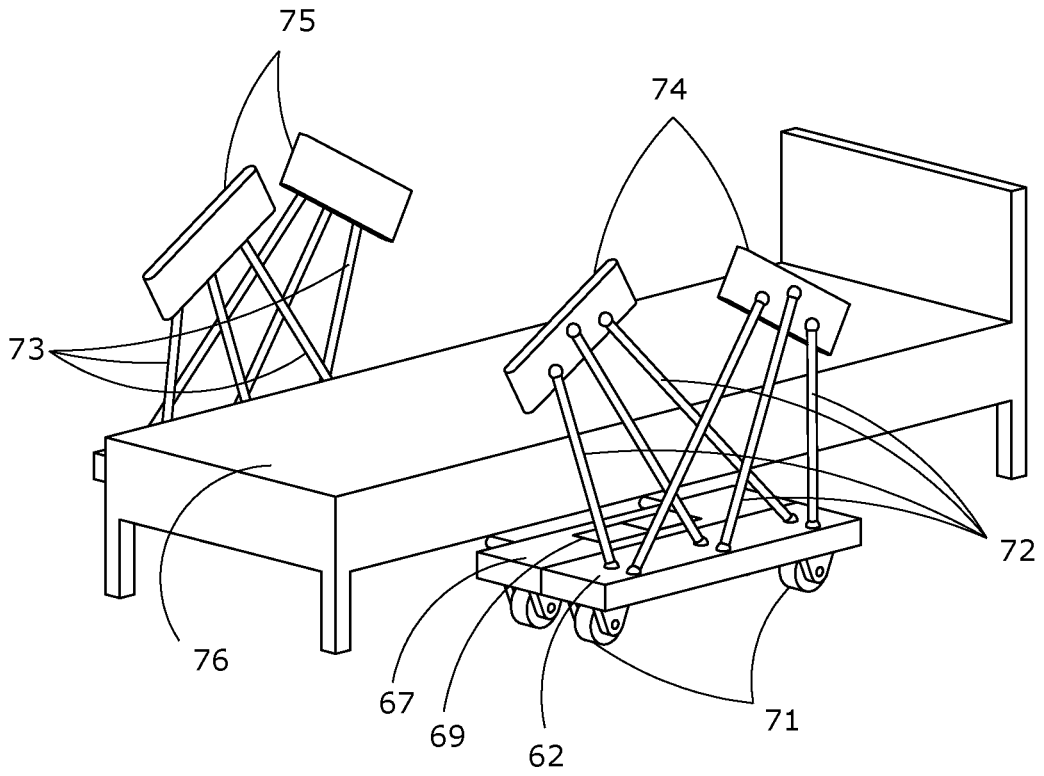
FIG. 6 shows the apparatus, wherein in the spaced apart configuration a first (right) part of the frame, footboard unit and supporting portion is relatively spaced to a second (left) part of the frame, footboard unit and supporting portion to allow placement on either side of a patient, according to an example of the present disclosure.

FIG. 6 shows the apparatus, wherein in the spaced apart configuration a first (right) part of the frame, footboard unit and supporting portion is relatively spaced to a second (left) part of the frame, footboard unit and supporting portion to allow placement on either side of a patient.

In FIG. 6, there is shown part of the footboard carrying the frame 62, Second (left) Central part of the footboard 67, Second (left) Scale 69, Second (left) Movable means 71, Second (left) part of the frame 72, First (right) part of the frame 73, Second (left) part of the supporting portion 74, First (right) part of the supporting portion 75 and Bed 76.

Figure 4:
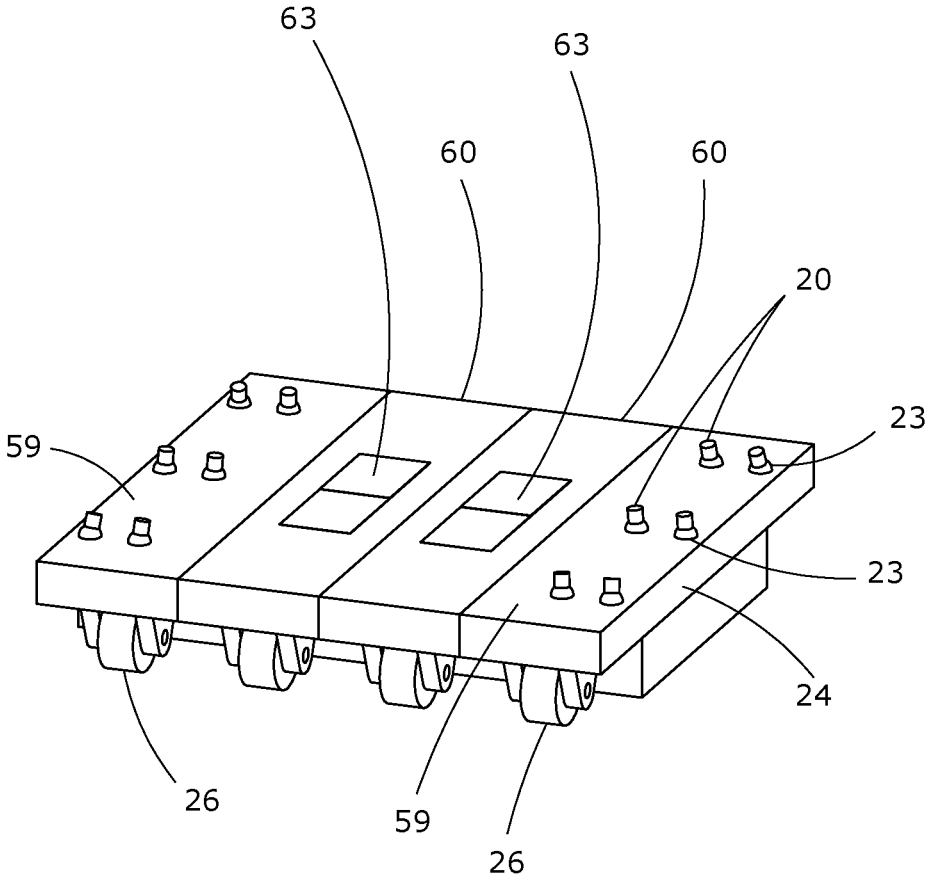
FIG. 4 shows a general view of the footboard 24, whereon the patient can stand according to an example of the present disclosure.

FIG. 4 shows a general view of the footboard 24. FIG. 4 shows part of the footboard carrying the frame 59, Central part of the footboard 60, Scale 63, Movable means 26, rods 20

Figure 5:
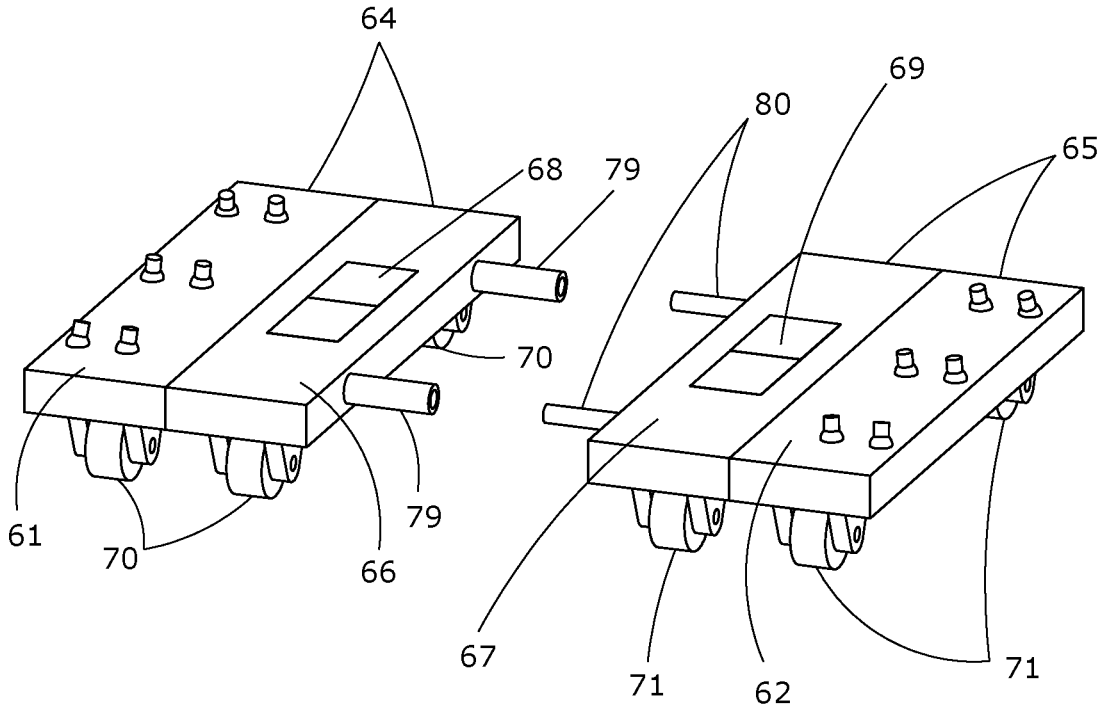
FIG. 5 shows a general view of a spaced apart configuration of the footboard relative to the bed, according to an example of the present disclosure.

FIG. 5 shows a general view of a spaced apart configuration of the footboard 24, which can be spaced on either side of the bed. There is shown in FIG. 5, first (right) part of the footboard 64, Second (left) part of the footboard 65, First (right) Part of the footboard carrying the frame 61, Second (left) Part of the footboard carrying the frame 62, First (right) Central part of the footboard 66, Second (left) Central part of the footboard 67, First (right) Scale 68, Second (left) Scale 69, First (right) Movable means 70, Second (left) Movable means 71, First right set of connection to space the footboard away and to pull it together as needed 79 and Second left set of connection to space the footboard away and to pull it together as needed 80.

The movable means comprises, for example, wheels or caterpillars. The wheels or the caterpillars are optionally motorized.

The apparatus 10 includes spaced apart and approximated configurations, wherein in the spaced apart configuration a first (right) part of the frame, footboard unit and supporting portion is relatively spaced to a second (left) part of the frame, footboard unit and supporting portion to allow placement on either side of a patient and an approximated position wherein the first and second parts are closer together to allow the patient to be supported from either side.

The apparatus comprises optionally at least one connector extending between the first and second parts in the spaced apart and the approximated configurations. The first and second parts are able to be spaced apart to a discretely or continuously variable degree.

The first and second parts are able to be moved between the spaced apart and approximated position preferably by motorization.

Figure 11A:
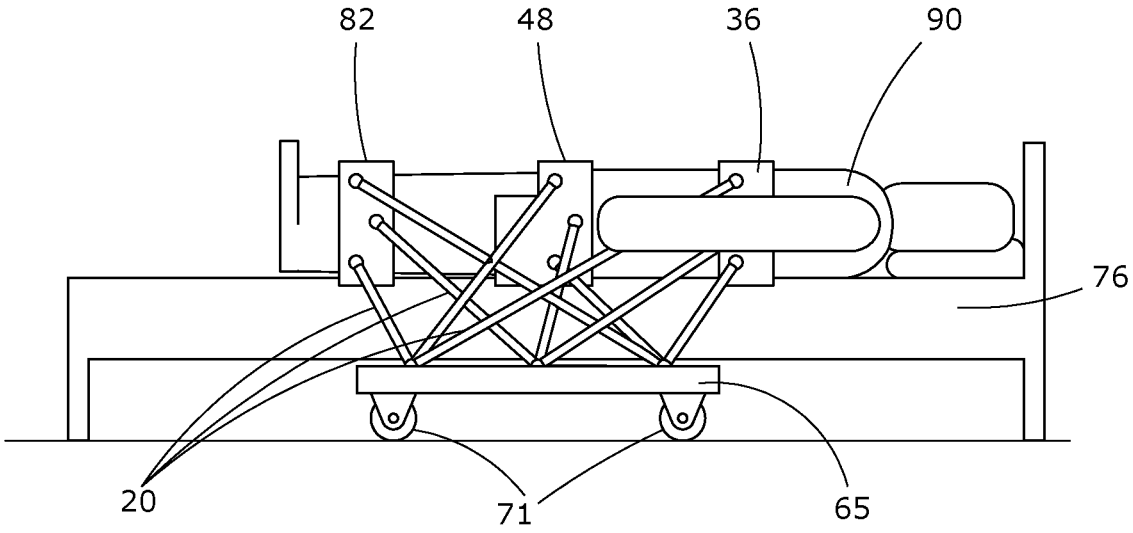
FIG. 11A shows a view of a patient being grasped by the apparatus (embodiment with upper, lower and leg supporting portions) in a lying position (left side view), according to an example of the present disclosure.
Figure 11B:
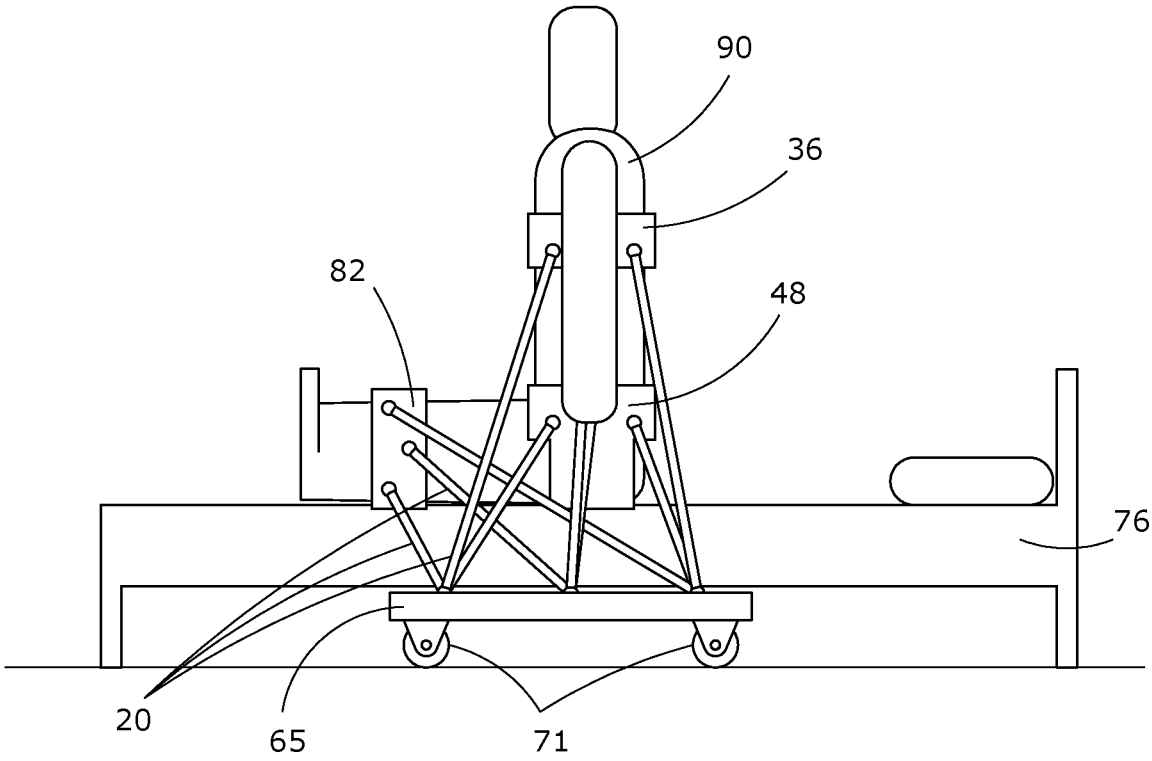
FIG. 11B shows a view of a patient being brought in a sitting position in the bed by the apparatus (embodiment with upper, lower and leg supporting portions), according to an example of the present disclosure.
Figure 11C:
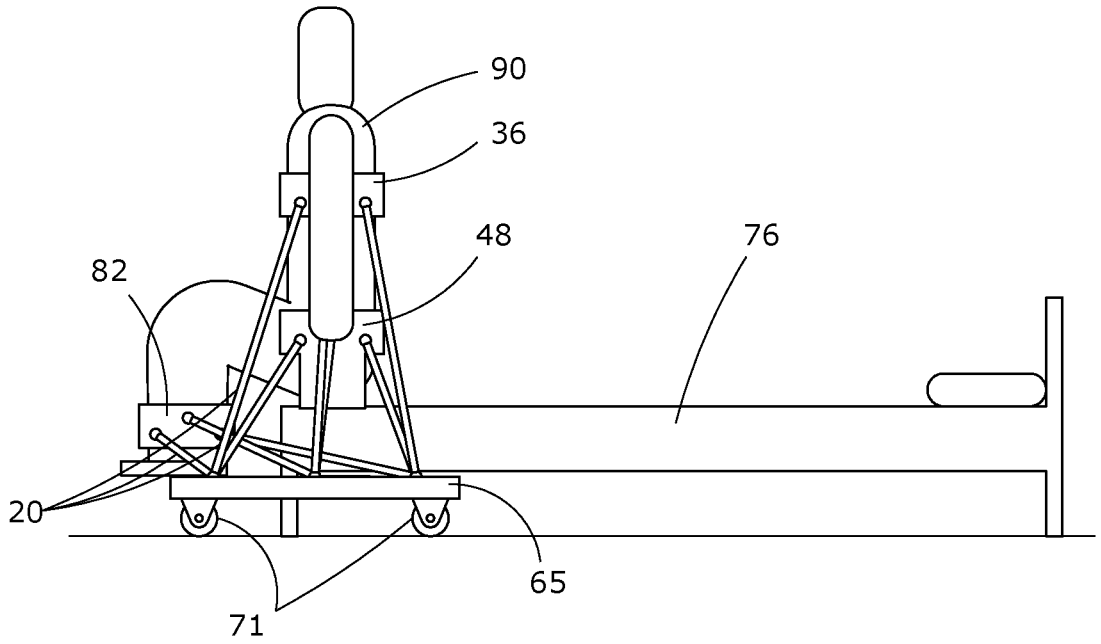
FIG. 11C shows a view of a patient being brought to the foot side of the bed in a sitting position by the apparatus (embodiment with upper, lower and leg supporting portions), according to an example of the present disclosure.

After grasping the paralyzed part of the patient's body like in FIG. 11A, the patient will optionally be brought to the front into a sitting position like in FIGS. 11B and 11C then into a standing position on the footboard like in FIG. 10A.

FIGS. 11A, B and C are conceptual diagrams showing a simplified transition of how the patient will be transferred from a lying to a sitting and standing position.

In the figures, the patient 90 lying on a bed 76 with the left side part of the upper supporting portion 36, the left side seat part of the lower supporting portion 48, the second (left) side part of the leg supporting portion 82, the Second (left) part of the footboard 65 and its Movable means 71 and the rods 20. The patient 90 will be grasped by a combination of these left side parts and cooperating right side parts as described above. The frame 12 can be height adjusted to bring the patient into sitting and standing positions. Further, the footboard unit 24 can be moved relative to the bed to allow the patient to be transferred to a foot end of the bed and then into a standing position beyond the foot end of the bed. The spaceability of the footboard unit 24 allows the apparatus 10 to be positioned on either side of the bed from grasping the patient and manipulating the patient on the bed. Further, the footboard unit 24 can be brought together from the spaced configuration to match a standing gate of the legs of the patient.

FIG. 11A shows a view of a patient being grasped by the apparatus in a lying position (left side view), according to an example of the present disclosure. Referring to FIG. 11B, there is a view of a patient being brought to a sitting position in the bed by the apparatus, according to an example of the present disclosure. FIG. 11C shows a view of a patient being brought to the foot side of the bed in a sitting position by the apparatus, according to an example of the present disclosure.

In one embodiment of FIGS. 12, 13, 14, 15 and 16 an alternative footboard comprises a central part 66, 67 configured to be positioned at a foot end of the bed, and the first and second parts 61, 62 are movable relative to the central part along respective sides of the bed along first and second guide members 83, 84.

Figure 12:
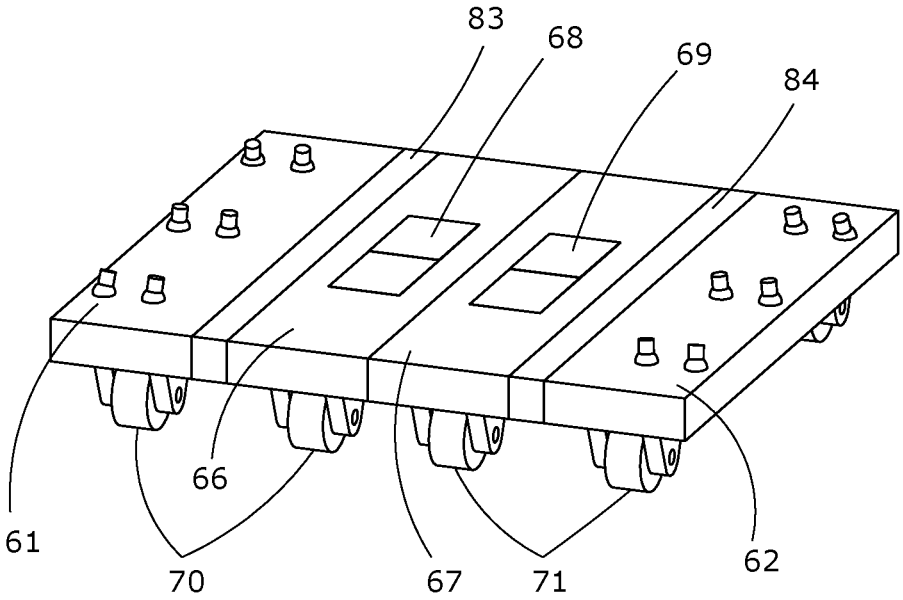
FIG. 12 shows a general view of an alternative footboard having extractable rails 83 and 84, whereon the patient can stand according to an example of the present disclosure.

FIG. 12 shows footboard with the first (right) extractable/deployable guide member (rails) (retracted) 83, the second (left) extractable guide member (retracted) 84, the first (right) part of the footboard carrying the frame 61, the second (left) Part of the footboard carrying the frame 62, the first (right) central part of the footboard 66, the second (left) Central part of the footboard 67, the first (right) Scale 68, the second (left) Scale 69, the first (right) Movable means 70 and the second (left) Movable means 71.

Figure 13:
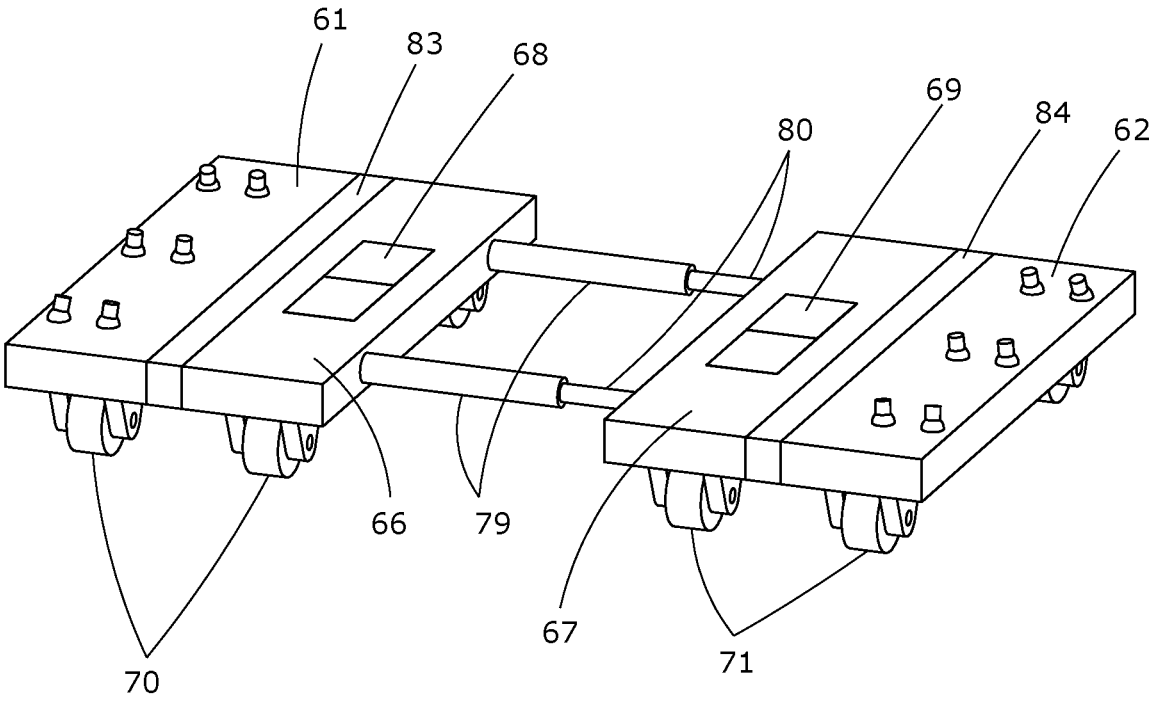
FIG. 13 shows a general view of a spaced apart configuration of the footboard relative to the bed, with the rails 83 and 84 folded according to an example of the present disclosure.

In FIG. 13 a general view of a spaced apart configuration of the footboard relative to the bed, with the first (right) 79 and the second (left) 80 set of connection to space the footboard away and to pull it together as needed.

Figure 14:
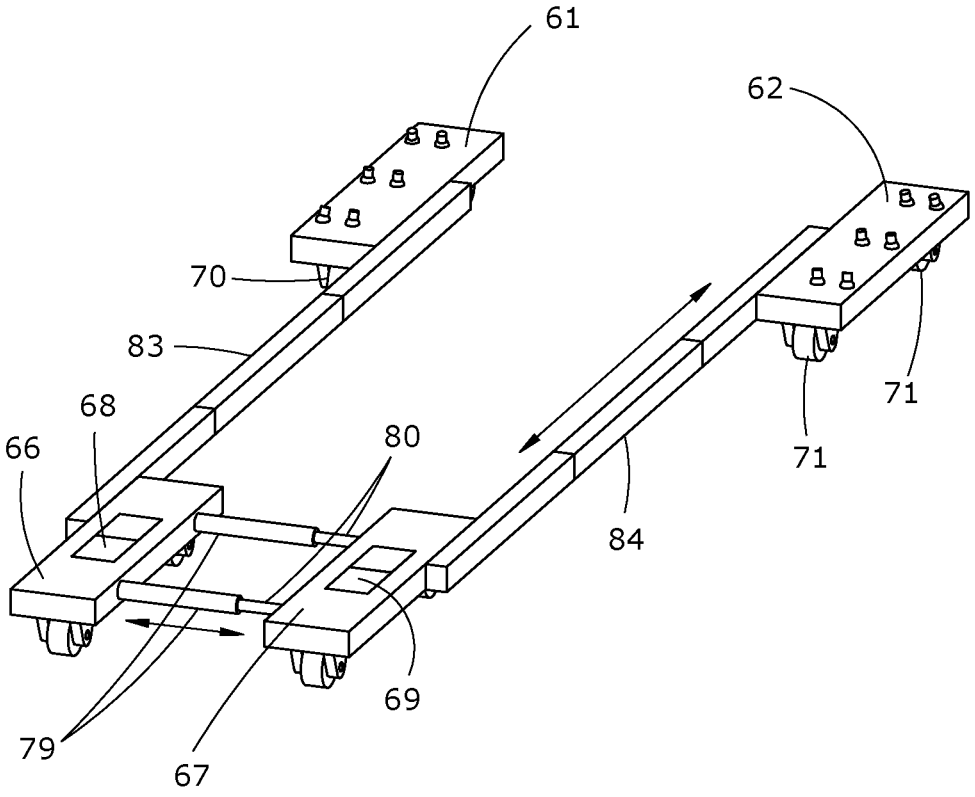
FIG. 14 shows a general view of a spaced apart configuration of the footboard relative to the bed, with the rails 83 and 84 deployed according to an example of the present disclosure.

A method of operation of the apparatus 10 will now be described with reference to FIGS. 14 and 15.

The central parts of the footboard unit 66, 67 are positioned at a foot end of the bed. The footboard will be spaced away laterally with the motorized connection 79, 80 approximately to the width of the bed. The first and second side parts of the footboard 61, 62 are movable relative to the central parts along respective sides of the bed along the first and second guide members 83, 84. The first and second guide members will respectively guide the movement of first and second side parts of the footboard unit relatively to the central parts of the footboard.

After grasping the patient, the frame on the side part of the footboard will move (carrying the patient) on the guide members. The guide members are rails in this embodiment. The rails will enable a guided movement of the frame and the patient towards the foot end of the bed to join the central part of the footboard. The Rails in FIG. 14: 83, 84 are able to be extended from the footboard unit from a retracted configuration to a deployed configuration. In FIG. 14, the guide members (rails) 83, 84 are fully retracted.

The first and second guide members are in one embodiment extractable rails from the footboard. Other option is to fix these rails on the right and left sides of the bed (not shown in the figures).

In another embodiment, there will be a groove (instead of rails, not show in the figures) in the side of the bed and in the central part of the footboard, which will guide the movement of first and second side parts 61, 62 of the footboard unit relatively to the central parts of the footboard.

The apparatus can comprise motorization for moving the first and second side parts of the footboard unit along the first and second guide members.

The movement of the first and second side parts of the footboard can be facilitated by raising or lowering the head or the foot end of the bed (using the motor of the bed). This will enable the frame to slide in the groove back and forth.

When the frame and the side parts of the footboard reach the foot end of the bed, it will leave the bed to join the central parts of the footboard.

All the movements mentioned above are optionally motorized. The motor can be integrated in the footboard.

Figure 16A:
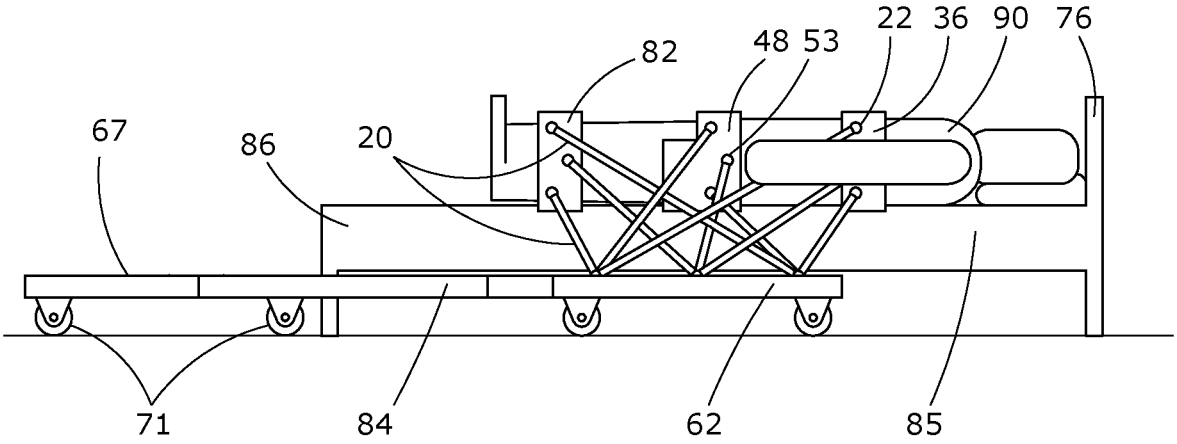
FIG. 16A shows a view of a patient being grasped by the apparatus, according to an example of the present disclosure.
Figure 16B:
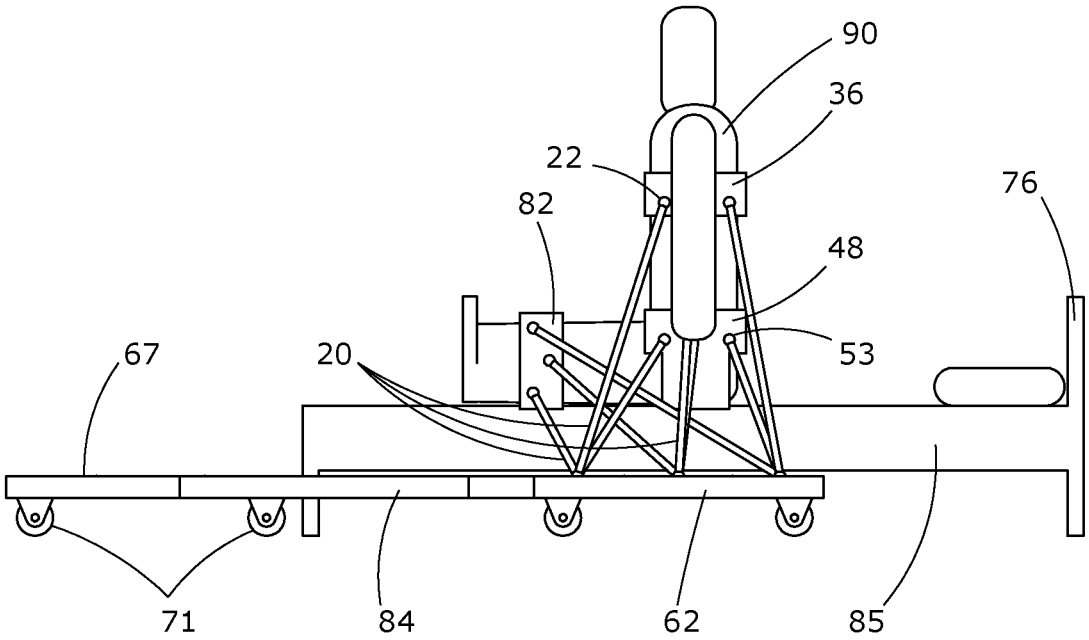
FIG. 16B shows a view of a patient being brought in a sitting position in the bed by the apparatus, according to an example of the present disclosure.
Figure 16C:
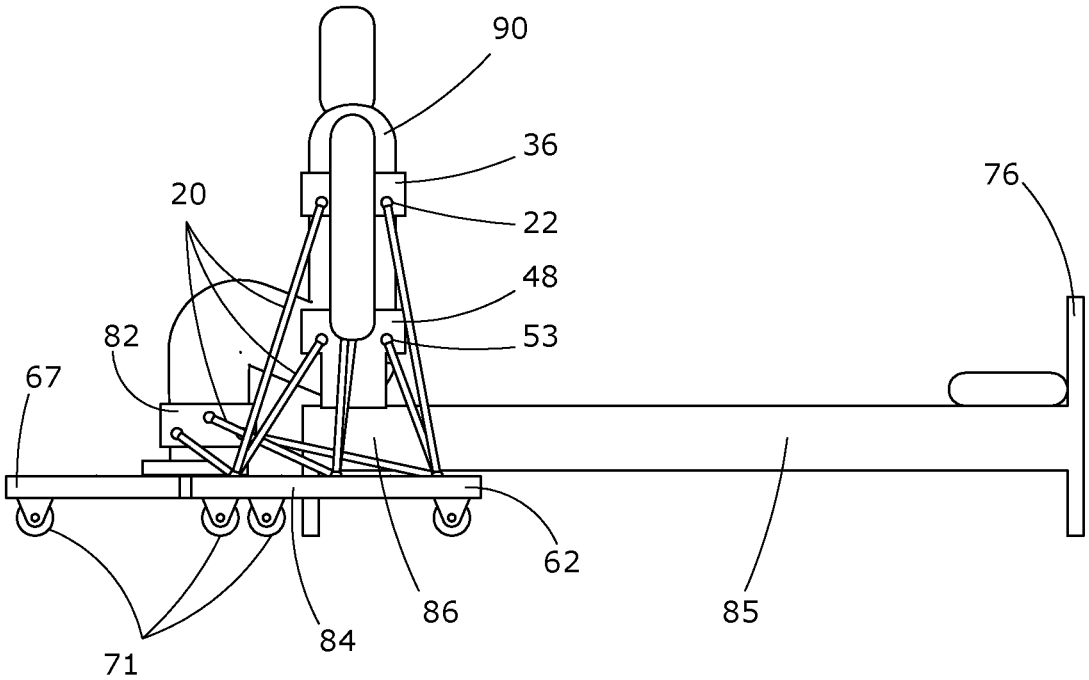
FIG. 16C shows a view of a patient being brought to the foot side of the bed in a sitting position by the apparatus, according to an example of the present disclosure.

After grasping the paralyzed patient like in FIG. 16A, the patient will optionally be brought to the front into a sitting position like in FIGS. 16B and 16C then into a standing position on the footboard like in FIG. 10A. FIGS. 16A, B and C are conceptual diagrams showing a simplified version of the transition of how the patient will be transferred from a lying to a sitting and standing position. In FIGS. 16A, B and C, there is shown a left side part of the upper supporting portion 36, motorized Spherical joints (rods @ supporting portion) 22, rods 20, left side seat part of the lower supporting portion 48, motorized Spherical joints (rods, supporting portion) 53, second (left) side part of the leg supporting portion 82, Second (left) part of the footboard: (Central part 67, side part 62), Second (left) Movable means 71, Bed 76, Foot side of bed 86, Side of the bed 85, Patient 90, Second (left) rail (guide member deployed in 16A&16B) 84.

FIG. 16A shows a view of a patient being grasped by the apparatus in a lying position (left side view). Referring to FIG. 16B, there is a view of a patient being brought in a sitting position in the bed by the apparatus. FIG. 16C shows a view of a patient being brought to the foot side of the bed in a sitting position by the apparatus.

In FIG. 16C we see the Second (left) rail (guide member half-retracted) 84.

Figure 7:
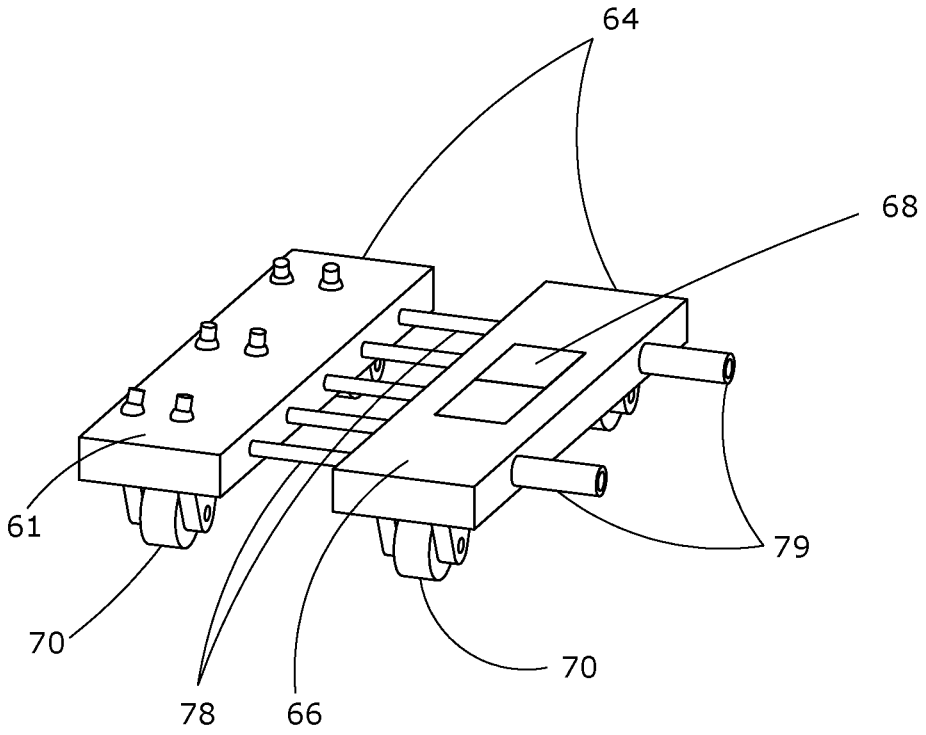
FIG. 7 shows an expanded view of the first (right) part of the footboard of an embodiment with pins 78 opening and closing to pass the bed leg, according to an example of the present disclosure.
Figure 9:
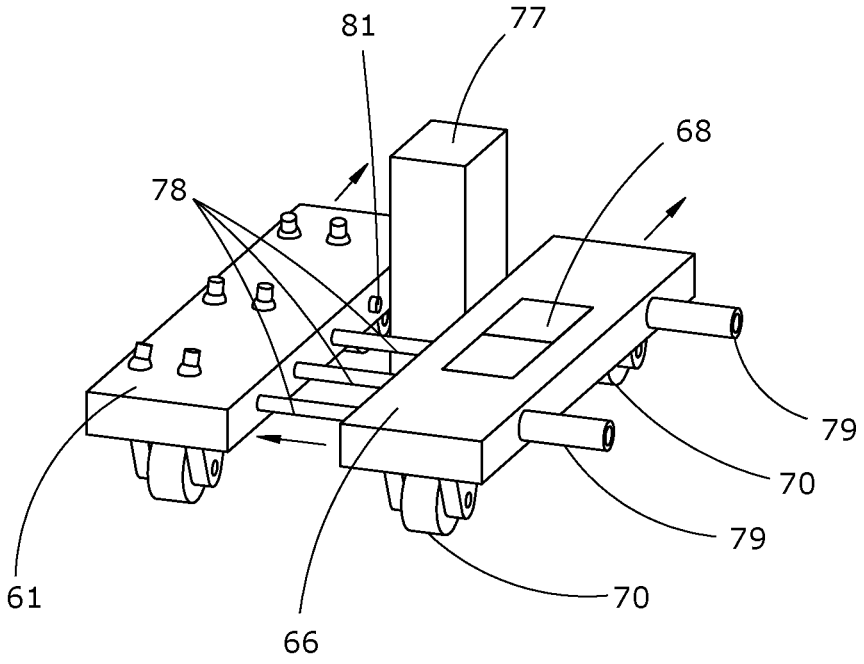
FIG. 9 shows an expanded view of the first (right) part of the footboard of an embodiment with pins opening and closing to pass the bed leg, according to an example of the present disclosure. In this figure, some of the pins are open to allow passing the leg of the bed.

In another embodiment, the footboard can get completely underneath the bed. An exemplary mechanism to pass the legs of the bed is shown in FIGS. 7 and 9.

Figure 15:
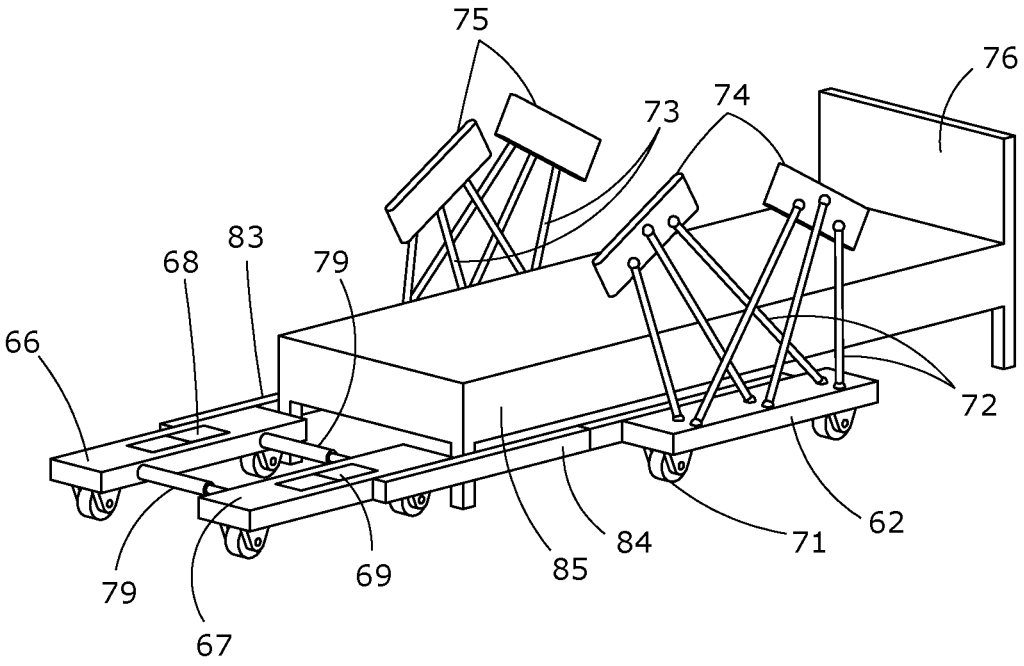
FIG. 15 shows the apparatus, wherein in the spaced apart configuration a first (right) part of the frame, footboard unit and supporting portion is relatively spaced to a second (left) part of the frame, footboard unit and supporting portion to allow placement on either side of a patient
Figure 17:
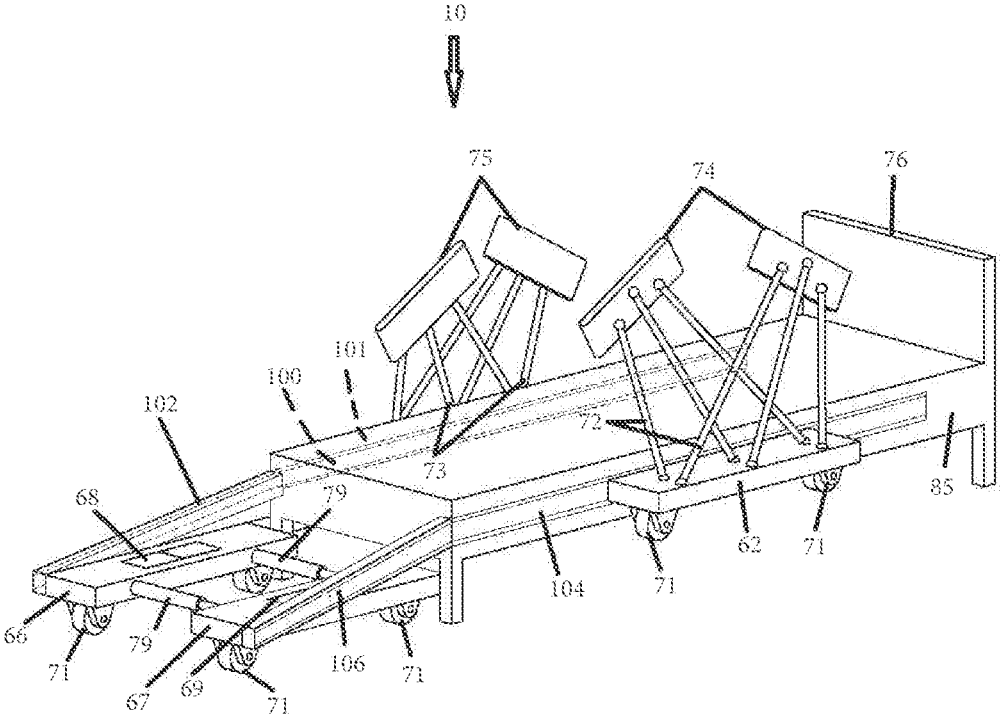
FIG. 17 shows the apparatus, wherein in the spaced apart configuration a first (right) part of the frame, footboard unit and supporting portion is relatively spaced to a second (left) part of the frame, footboard unit and supporting portion to allow placement on either side of a patient.

FIG. 17 illustrates the apparatus 10,which is similar to the apparatus of FIG. 15, but showing right guide member 100 on a right side 101 of the bed 76 and a right guide portion 102. Left guide member 104 is positioned on the left side 85 of the bed 76 along with a left guide portion 106. The first (right) central part of the footboard carrying the frame 66 is positioned next to right guide portion 102, and the second (left) part of the footboard carrying the frame 62 is positioned next to left guide portion 106. The first (right) part of the frame 73 is positioned on the right side 101 of the bed on the first (right) part of the footboard carrying the frame 61 (illustrated, for example, in FIG. 5), and the second (left) part of the frame 72 is positioned on the left side 85 of the bed 76 on the second (left) part of the footboard carrying the frame 62 and slidably connected to guide members 100, 102, respectively. The first (right) part of the frame 73 carries the first (right) part of the supporting portion 75. The second (left) part of the frame 72 carries the second (left) part of the supporting portion 74.

Figure 18A:
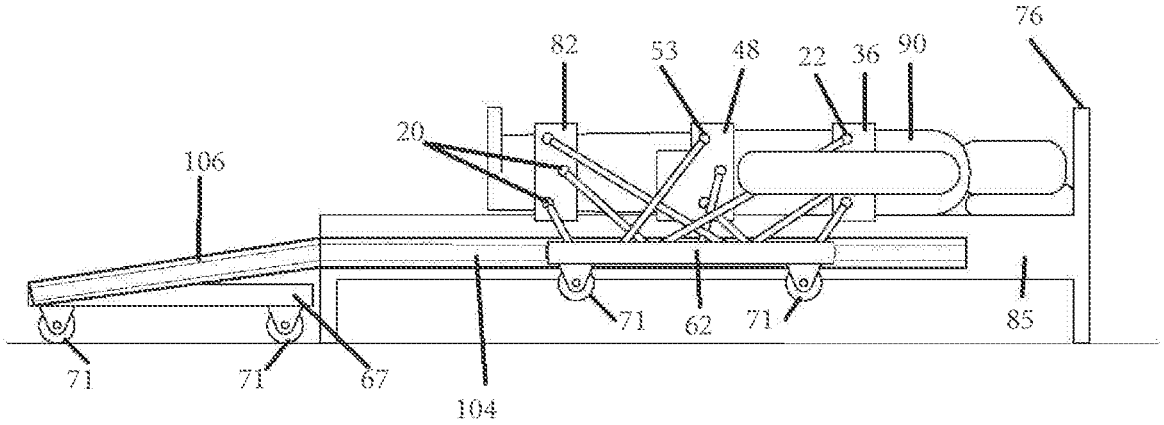
FIG. 18A shows a view of a patient being grasped by the apparatus, according to an example of the present disclosure.
Figure 18B:
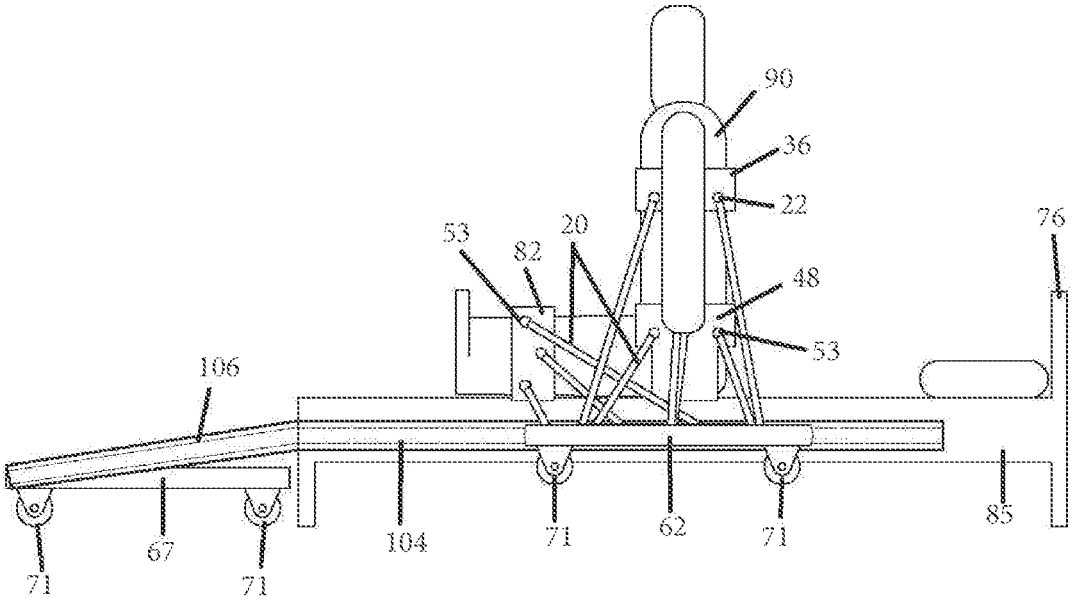
FIG. 18B shows a view of a patient being brought in a sitting position in the bed by the apparatus, according to an example of the present disclosure.
Figure 18C:
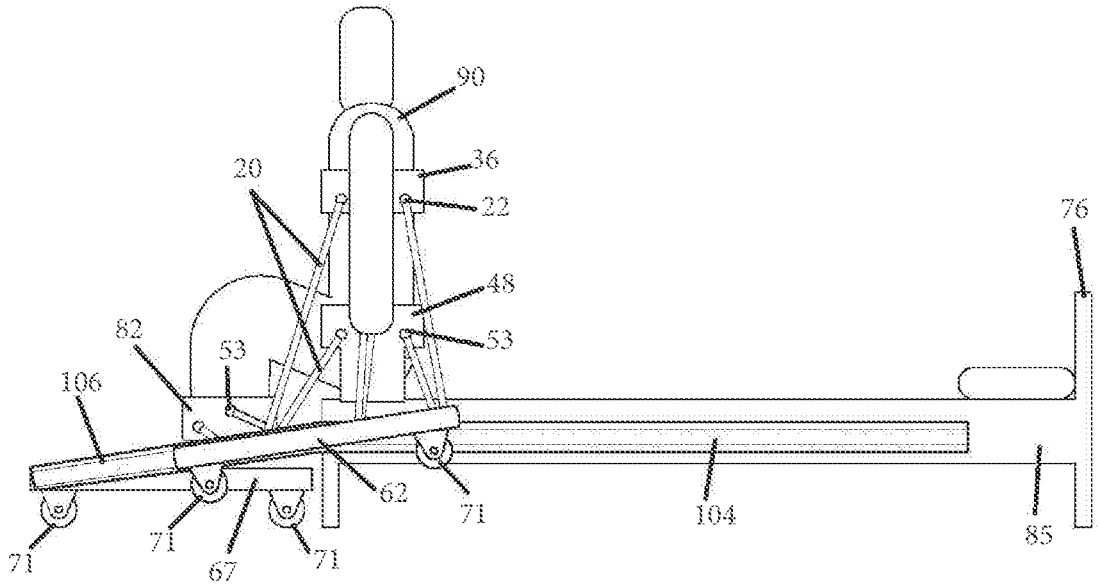
FIG. 18C shows a view of a patient being brought to the foot side of the bed in a sitting position by the apparatus, according to an example of the present disclosure.

FIG. 18A shows a view of a patient being grasped by the apparatus in a lying position (left side view). Referring to FIG. 18B, there is a view of a patient being brought in a sitting position in the bed by the apparatus. FIG. 18C shows a view of a patient being brought to the foot side of the bed in a sitting position by the apparatus.

In this embodiment, shown in FIGS. 18A-18C, after grasping the paralyzed patient 90, the patient will optionally be brought to the front into a sitting position like in FIG. 18B and 18C then into a standing position on the footboard like in FIG. I0A. FIGS. 18A, 18B and 18C are conceptual diagrams showing a simplified version of the transition of how the patient will be transferred from a lying to a sitting and standing position. In FIGS. 18A, 18B and 18C, there is shown a left side part of the upper supporting portion 36, motorized spherical joints (rods @ supporting portion) 22, rods 20, left side seat part of the lower supporting portion 48, motorized spherical joints (rods, supporting portion) 53, second (left) side part of the leg supporting portion 82, Second (left) part of the footboard: (Central part 67, side part 62), second (left) movable means 71, bed 76, side of the bed 85, patient 90, second (left) guide member 104 and left guide portion 106 (guide members 100, 102, and guide portions 104, 106, respectively, deployed in 18A-18C).

In FIG. 18C we see the left guide member 104 carrying the frame 62 slideably engaging the guide portion 106.

FIG. 7 shows an expanded view of the first (right) part of the footboard of this embodiment with pins 78 opening and closing to pass the bed leg, the first (right) part of the footboard 64, the first (right) Part of the footboard carrying the frame 61, the first (right) Central part of the footboard 66, the first (right) Scale 68, the first (right) Movable means 70 and the first right set of connection to space the footboard away and to pull it together as needed 79. The parts 61, 66 of a left part of the footboard unit are connected by the pins 78, which can be sequentially opened to allow a leg of the bed to pass and closed to maintain connection of the parts 61, 66. Corresponding features are provided on a second (left) part of the footboard 64.

FIG. 9 shows as well an expanded view of the first (right) part of the footboard of this embodiment with pins opening and closing to pass the bed leg. Here some of the pins are open to allow passing the leg of the bed. Other of the pins 78 maintain a connection between parts 61, 66 to maintain the footboard unit in an assembled state. Also shown is the bed leg 77, the first (right) set of Pins closed 78: Pins between the central part of the footboard and the part of the footboard carrying the frame, one pin opened to allow passing the bed leg 81, the first (right) Part of the footboard carrying the frame 61, the first (right) Central part of the footboard 66, the first (right) Scale 68, the first (right) Movable means 70, the first right set of connection to space the footboard away and to pull it together as needed 79.

The pins (FIGS. 7 and 9: 78, 81) between the central part of the footboard and the part of the footboard carrying the frame. These pins will open and close, optionally in a motorized way, to enable the footboard to pass through the bed and at the same time the footboard will be connected to each other through connectors 79, 80 to provide stability.

Figure 8:
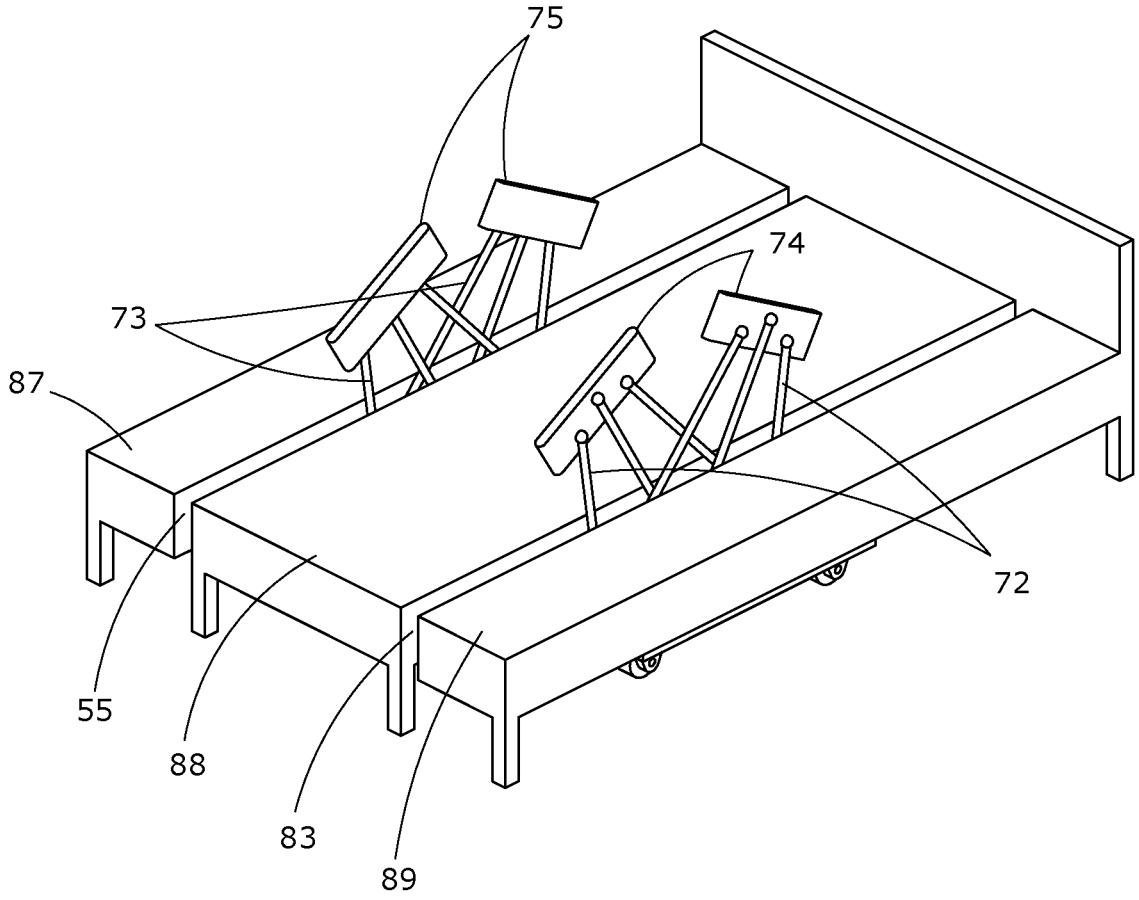
FIG. 8 shows an expanded view of a specially adapted bed comprising slots extending longitudinally on respective lateral sides of the bed through which first and second parts of the frame, each with respective parts of the supporting portion, are extendable and are movable along the slots, according to an example of the present disclosure.

In a different embodiment according to FIG. 8, a frame of the bed, optionally motorized, will open slots 55, 83 longitudinally on respective lateral sides of the mattress of the bed and the frame of the bed through which first and second parts of the frame, each with respective parts of the supporting portion, are extendable and are movable along the slots.

In FIG. 8, there is shown a first (right) slot in the bed 55, the second (left) slot in the bed 83, the first (right) part of the frame 73, the second (left) part of the frame 72, the first (right) part of the frame 73, the second (left) part of the supporting portion 74, the first (right) part of the supporting portion 75, the bed 76, the first (right) part of the bed 87, the central part of the bed 88 and the second (left) part of the bed 89.

When the disabled person decides to sit, stand or go to the toilet then he/she can choose to open slots extending longitudinally on respective lateral sides of this specially adapted bed. This process is preferably motorised and will divide the bed (frame and mattress) into three parts. The patient should be lying on the middle part of the bed. The apparatus can now move in the respective slots to grasp and mobilise the patient in the way described with respect to FIGS. 11A, 11B and 11C. When the patient finishes using the apparatus and wants to get into bed again, the apparatus will bring the patient back on the bed, moves out of the slots and then the slots close to bring the bed (frame and mattress) to the initial configuration as one piece.

In a different embodiment (not shown in the drawings), the footboard unit is located at a foot end of a bed in a vertical orientation and the supporting portion is able to grasp the patient in a lying position on the bed, wherein the footboard unit is able to be moved into a horizontal orientation, thereby moving the patient into a standing position. In this embodiment, the footboard does not move underneath the bed. It stays all the time at the foot end of the bed.

Grasping the patient will take place when the frame and the supporting portion extends horizontally from the footboard and parallel to the patient so that the supporting portions can be placed on the side of the body of the patient, preferably in a motorized way.

The movement of the footboard from the vertical orientation to the horizontal orientation can be motorized.

The motorization operates on the bed to raise a head end of the bed or the motorization operates on the footboard unit to move the footboard unit relative to the bed.

As described herein, the waist supporting portion means lower supporting portion.

In FIG. 3, there is shown a lower supporting portion 16 for grasping the lower body of a patient and for configuring a seat of the wheelchair. In this figure, there is shown a right seat part of the lower supporting portion: 40, right front seat part of the lower supporting portion 41, right back seat part of the lower supporting portion 42, right side seat part of the lower supporting portion 43, right lower bottom seat part of the lower supporting portion 44, left seat part of the lower supporting portion 45, left front seat part of the lower supporting portion 46, left back seat part of the lower supporting portion 47, left side seat part of the lower supporting portion 48, left lower bottom seat part of the lower supporting portion 49, Gap between the first and second seat parts 50, Rods 20 Joints between the different parts 51, Rigid connection: connecting the two back parts of the lower supporting portion together 52, Rigid connection: connecting the two lower bottom seat parts of the lower supporting portion together. 54, motorized Spherical joints (rods, lower supporting portion) 53.

The waist supporting portion comprises first and second seat parts that are to be positioned on opposed side of the patient when the patient is standing or lying and which are able to be connected together to form the seat, thereby converting from the configuration for supporting the patient around the waist when the patient is standing to the configuration having the seat for supporting the patient when the patent is in a sitting position.

The right and left lower seat parts (FIG. 3: 44, 49) will extend preferably in a motorized telescopic way form each side to meet each other and form the bottom of the chair.

In a similar way, the right and left back seat parts (FIG. 3: 42, 47) will extend preferably in a motorized telescopic way from each side to meet each other and form the back of the chair. In a similar way, the right and left front seat parts (FIG. 3: 41, 46) will extend preferably in a motorized telescopic way from each side in front of the belly of the patient and prevent the paralyzed patient from sliding and falling out of the chair.

At least the right and left lower seat parts may have sensors (not shown in the figures) on each side to pay a special attention to the male genital area and not to close completely if the male genitals are in the way.

The seat is able to be moved between an approximated position in which the first and second seat parts 44, 49 are adjacent one another to a spaced apart position in which the first and second seat parts form a gap 50 therebetween to facilitate urination and/or bowel movement of the patient.

Figure 10B:
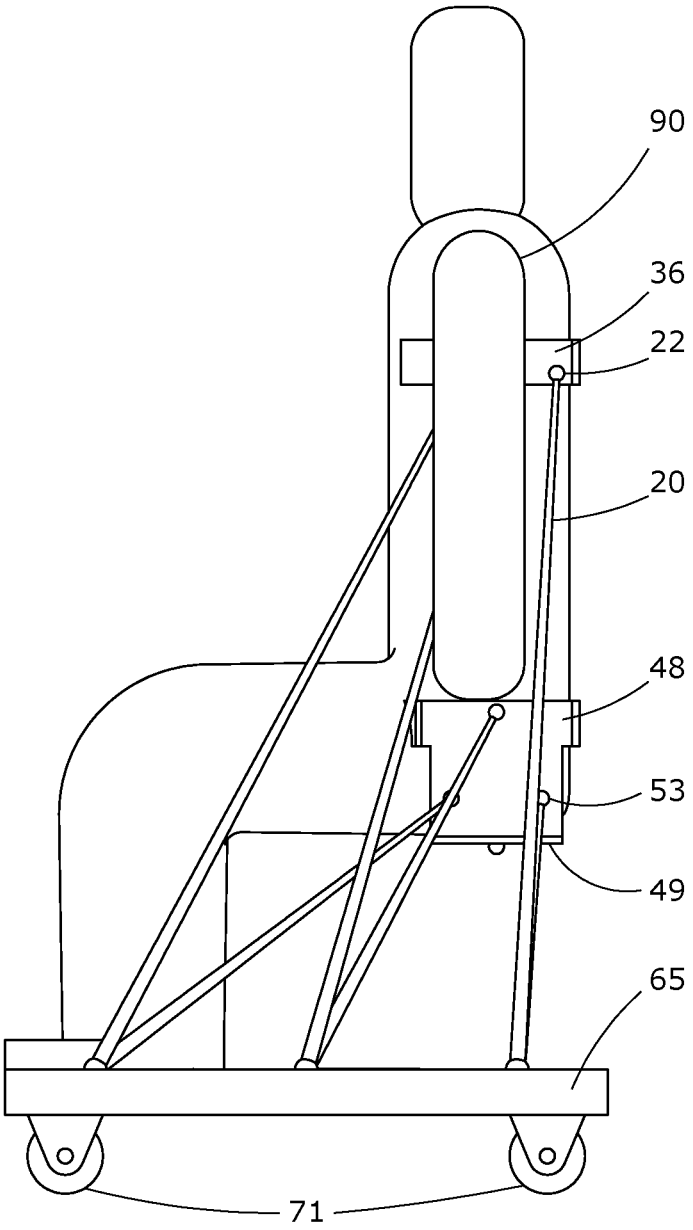
FIG. 10B provides a view of a patient being supported by the apparatus (embodiment with upper and lower supporting portions) in a sitting position (left side view), according to an example of the present disclosure.

In FIG. 10B, there is shown a patient being supported by the apparatus (embodiment with upper and lower supporting portions) in a sitting position (left side view). In FIG. 10B, there is shown a left side part of the upper supporting portion 36, motorized Spherical joints (rods, supporting portion) 22, rods 20, left side seat part of the lower supporting portion 48, left lower bottom seat part of the lower supporting portion 49, motorized Spherical joints (rods, supporting portion) 53, Second (left) part of the footboard 65 and Second (left) Movable means 71.

FIG. 2 shows an upper supporting portion 14 for grasping the upper body of a patient. In this figure, we see a (right) part of the upper supporting portion 28, Right front part of the upper supporting portion 30, Right back part of the upper supporting portion 31, Right side part of the upper supporting portion 32, Second (left) part of the upper supporting portion 33, Left front part of the upper supporting portion 34, Left back part of the upper supporting portion 35, side part of the upper supporting portion 36, Joints between the different parts (for example between the side and front parts) 37, Rigid connection: connecting the two back part together of the upper supporting portion. 38, Motorized Spherical joints (rods, upper supporting portion) 22 and Rods 20. The right and left back parts of the upper supporting portions 31, 35 will extend preferably in a motorized telescopic way from each side to meet each other and support the back of the patient. In the same approach, the right and left front parts 30, 34 of the upper supporting portion will extend preferably in a motorized telescopic way from each side in front of the chest of the patient and prevent the paralyzed patient from falling.

In yet another embodiment (not shown), the apparatus comprises a patient suit, optionally made of fabric, wherein the supporting portion and the patient suit include cooperating attachment means (not shown in the figures). This cooperating attachment means comprises plural members located at separate areas on opposed sides and optionally the front and back of the patient suit to guide positioning of the supporting portion and ensure attachment. The cooperating attachment means comprise magnets, Velcro or hook and loop fasteners. The suit can include arm holes, a torso covering portion, sleeves, trouser or shorts with leg holes and/or a neck that are optionally integrated together to share load bearing.

The patient suit comprises an openable portion to allow passage of bodily wastes to a toilet.

The first and second seat parts are able to be moved apart when the patient requires passage of bodily waste in order to open the openable portion of the patient suit.

Opening the openable portion of the patient suit is preferably motorized like in the motorised movement of the seat because the suit is attached to the seat.

In various embodiments of the present disclosure, the apparatus comprises a controller and motorization configured to automate various motorized aspects of the apparatus. One example would be transport of the patient from the bed to another location such as a toilet and return the patient back to the bed. Further, automated functions can include height adjustment of the frame, spacing and bringing together of the footboard, grasping of the patient with the support portions, exercising of the patient (described further below), raising or lowering of the bed, creating slots in the bed, room navigation along the floor of the apparatus, patient weight balancing, chair adjustment, transitioning of the patient between sitting, lying and standing positions, etc.

Figure 19:
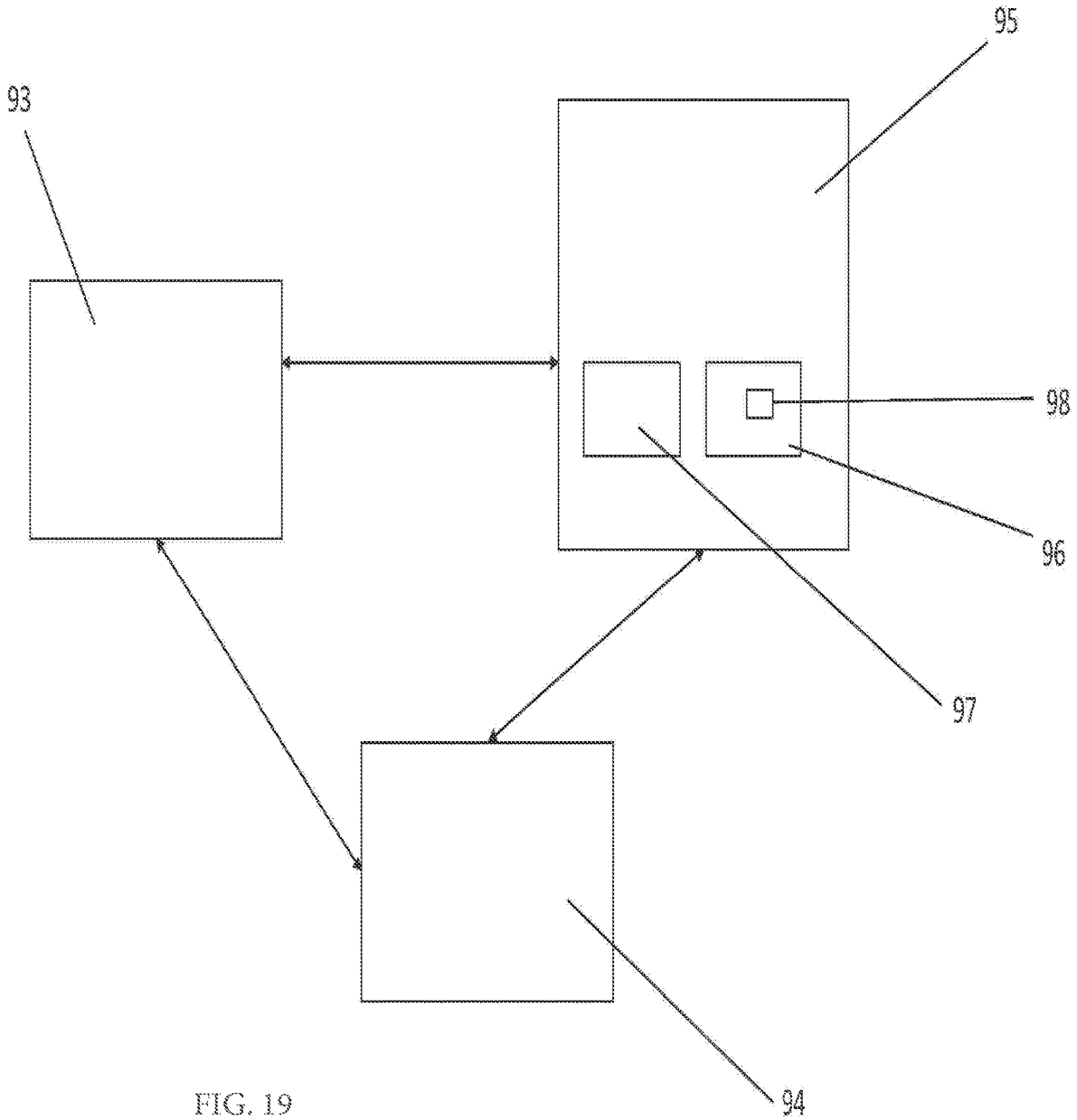
FIG. 19 shows a simplified block diagram of the automation aspect; indicating one or more motors. The motor has been shown in block form for the purposes of clarity. In practice, the motor would be integrated into the footboard unit.

Such automated functionality can be implemented through an automation system as shown in FIG. 19 that includes various components including a motor 93, a power source 94, a controller 95, a memory 96, a processor 97 and computer program instructions 98. The automation system may be configured to operate the motor 93 in order to execute an automation function, such as height adjustment, through computer program instructions 98 stored on memory 96 executed by processor 97 of controller 95. Sensory feedback may be employed for controlling the automation function. Separate automation systems as shown in FIG. 19 may be provided for each automation/motorization function described herein, or shared automation systems can be used.

With reference to FIG. 10 A, a balancing capability of the apparatus will be described, according to one aspect of the present disclosure. The apparatus is configured so that the opposed sides of the frame are independently height adjustable so as to laterally redistribute the weight of the patient. The footboard unit comprises at least one weighing sensor (not shown in the FIG, but scales 63 have been described above) to measure weight distribution of the patient.

The purpose of laterally redistributing the weight is to prevent the patient from falling in case he or she starts applying more weight in any direction. The sensor on the scale will send signals to adjust the height of certain rods to bring the patient back into a balanced position.

In another aspect of the present disclosure, the apparatus is configured to include a controller and motorization as part of a training unit to automate or semi-automate exercise of the patient.

The training unit comprises at least the lower supporting portion and the leg supporting portion as shown in FIGS. 11A to 11C, which will enable a controlled exercise of the lower extremities. This training may simulate an elliptical trainer. The apparatus can be configured so that it simulates a stationary bike exercising or to exercise on a treadmill. In all these cases, the patient will be able to exercise with exact controlled movements with the allowed weight to bear on each limb.

Additional supporting portions for the upper legs, lower legs, knees and soles of the feet will be needed.

Let's take the case of a patient after certain orthopaedic operations. The patient has to walk with a partial weight bearing of 15 kg on the operated limb. The independent height adjustability of each of the frame (rods) and the ability to pivot in all directions will enable exercising with exact allowed weight and range of motion because the frame will be carrying the rest of the weight and the movement will be well controlled.

In one embodiment, the supporting portions and the frame will collapse to be stowed in the side of the patient's bed to make it easier to be used when the patient needs to stand up and move around. The footboard will stay at the foot end of the bed.

In another embodiment, the frame and the supporting portion are collapsible to be stowed in the footboard unit and this footboard will be at the foot end of the bed.

The present apparatus on its own is foldable and compact.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms enclosed. On the contrary, the intention is to cover all modifications, alternative constructions, and equivalents falling within the spirit and scope of the invention, as defined in the appended claims. Thus, it is intended that the present invention cover the modifications and variations of this invention, provided they are within the scope of the appended claims and their equivalents.

The invention claimed is:

1. An apparatus for transporting a patient, the apparatus comprising:

a supporting portion to grasp part of the body of a patient;

a footboard unit upon which the patient is able to stand when supported by the supporting portion, the footboard unit movable along a floor by movable means;

a frame connected between the footboard unit and the supporting portion;

the apparatus configured so that the footboard unit is able to move in proximity to a bed upon which the patient is lying, wherein the supporting portion can grasp the part of the body of the patient, wherein the frame and the supporting portion are able to support the patient in transitioning from a lying position on the bed to a standing position adjacent the bed as the footboard unit is moved relative to the bed, wherein the supporting portion comprises a waist supporting portion that is able to be converted from a configuration for supporting the patient around the waist when the patient is standing to a configuration having a seat for supporting the patient when the patient is in a sitting position.

2. The apparatus of claim 1, wherein the frame is height adjustable to accommodate the patient in lying, sitting, and standing positions.

3. The apparatus of claim 2, wherein the height adjustability is motorized.

4. The apparatus of claim 2, wherein the frame includes a telescopic mechanism for height adjustability.

5. The apparatus of claim 1, wherein the ability to grasp is motorized.

6. The apparatus of claim 5, comprising a controller and at least one sensor configured to operate in a feedback loop with the motorized ability to grasp to ensure optimal grasping pressure is applied to the patient.

7. The apparatus of claim 1, wherein the supporting portion comprises separable first and second parts, respectively locatable on opposed sides of the patient and connectable to one another behind the back of the patient, in order to grasp the part of the body of the patient.

8. The apparatus of claim 1, wherein the movable means comprises wheels.

9. The apparatus of claim 8, wherein the wheels are motorized.

10. The apparatus of claim 1, wherein opposed sides of the frame are independently height adjustable so as to laterally redistribute the weight of the patient.

11. An apparatus for transporting a patient, the apparatus comprising:

a supporting portion to grasp part of the body of a patient;

a footboard unit upon which the patient is able to stand when supported by the supporting portion, the footboard unit movable along a floor by movable means;

a frame connected between the footboard unit and the supporting portion;

the apparatus configured so that the footboard unit is able to move in proximity to a bed upon which the patient is lying, wherein the supporting portion can grasp the part of the body of the patient, wherein the frame and the supporting portion are able to support the patient in transitioning from a lying position on the bed to at least one of a) a sitting position, and b) a standing position adjacent the bed as the footboard unit is moved relative to the bed; and first and second guide members locatable on either side of the bed for respectively guiding movement of first and second parts of the footboard.

12. The apparatus of claim 11 wherein the guiding movement is sliding.

13. The apparatus of claim 1, wherein the waist supporting portion comprises first and second seat parts that are to be positioned on opposed side of the patient when the patient is standing or lying and which are able to be connected together to form the seat, thereby converting from the configuration for supporting the patient around the waist when the patient is standing to the configuration having the seat for supporting the patient when the patent is in a sitting position.

14. The apparatus of claim 1, wherein the seat is able to be moved between an approximated position in which the first and second seat parts are adjacent one another to a spaced apart position in which the first and second seat parts form a gap there between to facilitate urination and/or bowel movement of the patient.

15. The apparatus of claim 11 wherein the first and second guide members comprise guide rails.

16. The apparatus of claim 11 wherein the first and second guide members are integrated into opposed sides of the bed.

17. The apparatus of claim 11, wherein the supporting portion includes a waist supporting portion which comprises first and second seat parts that are to be positioned on opposed side of the patient when the patient is standing or lying and which are able to be connected together to form a seat, thereby converting from the configuration for supporting the patient around a portion of a waist of the patient when the patient is standing to a configuration having the seat for supporting the patient when the patent is in a sitting position.

18. The assembly of claim 17, wherein the seat is able to be moved between an approximated position in which the first and second seat parts are adjacent one another to a spaced apart position in which the first and second seat parts form a gap there between to facilitate urination and/or bowel movement of the patient.

19. The apparatus of claim 11, wherein opposed sides of the frame are independently height adjustable so as to laterally redistribute the weight of the patient.

20. An apparatus for transporting a patient, the apparatus comprising:

a supporting portion to grasp part of the body of a patient;

a footboard unit upon which the patient is able to stand when supported by the supporting portion, the footboard unit movable along a floor by movable means;

a frame connected between the footboard unit and the supporting portion;

the apparatus configured so that the footboard unit is able to move in proximity to a bed upon which the patient is lying, wherein the supporting portion can grasp the part of the body of the patient, wherein the frame and the supporting portion are able to support the patient in transitioning from a lying position on the bed, to at least one of a) a sitting position, and b) a standing position adjacent the bed as the footboard unit is moved relative to the bed; and spaced apart and approximated configurations, wherein in the spaced apart configuration a first part of the frame, footboard unit and supporting portion is relatively spaced to a second part of the frame, footboard unit and supporting portion to allow placement on either side of a patient and an approximated position wherein the first and second parts are closer together to allow the patient to be supported from either side.

21. The assembly of claim 20, wherein the supporting portion includes a waist supporting portion which comprises first and second seat parts that are to be positioned on opposed side of the patient when the patient is standing or lying and which are able to be connected together to form a seat, thereby converting from a configuration for supporting the patient around a portion of a waist of the patient when the patient is standing to a configuration having the seat for supporting the patient when the patent is in a sitting position, wherein the conversion between configurations.

22. The apparatus of claim 20, wherein opposed sides of the frame are independently height adjustable so as to laterally redistribute the weight of the patient.

* * * * *